US012091787B2

(12) United States Patent
Rizzi et al.

(10) Patent No.: US 12,091,787 B2
(45) Date of Patent: Sep. 17, 2024

(54) NEEDLE-HOLDING UNIT FOR A CIRCULAR KNITTING MACHINE

(71) Applicant: SANTONI S.P.A., Brescia (IT)

(72) Inventors: Stefano Rizzi, Brescia (IT); Marco Andreoli, Castegnato (IT); Andrea Lonati, Brescia (IT)

(73) Assignee: SANTONI S.P.A., Brescia (IT)

( * ) Notice: Subject to any disclaimer, the term of this patent is extended or adjusted under 35 U.S.C. 154(b) by 178 days.

(21) Appl. No.: 17/614,480

(22) PCT Filed: May 21, 2020

(86) PCT No.: PCT/IB2020/054838

§ 371 (c)(1),
(2) Date: Nov. 26, 2021

(87) PCT Pub. No.: WO2020/240363

PCT Pub. Date: Dec. 3, 2020

(65) Prior Publication Data

US 2022/0228304 A1 Jul. 21, 2022

(30) Foreign Application Priority Data

May 27, 2019 (IT) ..... 102019000007380

(51) Int. Cl.
*D04B 15/14* (2006.01)
*D04B 15/32* (2006.01)

(52) U.S. Cl.
CPC ..... *D04B 15/14* (2013.01); *D04B 15/32* (2013.01)

(58) Field of Classification Search
CPC . D04B 9/00; D04B 9/06; D04B 15/10; D04B 15/14; D04B 15/32
See application file for complete search history.

(56) References Cited

U.S. PATENT DOCUMENTS 1,035,656 A * 8/1912 Swinglehurst ..... D04B 15/34 66/115
2,568,806 A * 9/1951 Henning ..... D04B 9/44 66/115

(Continued)

FOREIGN PATENT DOCUMENTS

EP 0036195 A2 9/1981
GB 474708 A 11/1937

(Continued)

OTHER PUBLICATIONS

Search Report dated Sep. 11, 2020 in corresponding International Application No. PCT/IB2020/054838, 5 pages. PCT/IB2020/054838, 11.

(Continued)

*Primary Examiner* — Danny Worrell
(74) *Attorney, Agent, or Firm* — MH2 TECHNOLOGY LAW GROUP LLP

(57) ABSTRACT

A needle-holding unit for circular knitting machines has a structure shaped as a hollow solid of rotation developing around a central axis is configured for turning around said central axis and for supporting a plurality of needles moving so as to produce a knitted fabric. The needle-holding unit exhibits on an outer side at least one working surface, on which a plurality of needle seats is defined, which are placed beside one another and arranged around the central axis. Each of the needle seats movably houses at least a portion of at least one respective needle which can be actuated with an alternate motion along the respective needle seat with a motion of extraction and a motion of return, in order to produce knitted fabric. Each needle seat has an inclined longitudinal development with respect to the central axis. The working surface has a shape as a surface of rotation obtained through the rotation of the inclined needle seats (Continued)

around the central axis, and in particular the working surface is a non-cylindrical, non-conical three-dimensional surface.

20 Claims, 13 Drawing Sheets

(56) References Cited

U.S. PATENT DOCUMENTS

| | | | | | |
|---|---|---|---|---|---|
| 3,543,280 | A * | 11/1970 | Greczin | D04B 9/44 | 66/115 |
| 3,977,214 | A * | 8/1976 | Greczin | D04B 15/14 | 66/115 |
| 7,878,029 | B2 * | 2/2011 | Lonati | D04B 9/46 | 66/149 S |
| 10,697,096 | B2 * | 6/2020 | Lonati | D04B 15/34 | |
| 2012/0210752 | A1 * | 8/2012 | Ragner | D04B 9/44 | 66/13 |
| 2017/0350047 | A1 * | 12/2017 | Lonati | D04B 35/04 | |
| 2022/0228304 | A1 * | 7/2022 | Rizzi | D04B 15/14 | |

FOREIGN PATENT DOCUMENTS

| | | | | |
|---|---|---|---|---|
| WO | 2016097974 | A1 | 6/2016 | |
| WO | 2018223521 | A1 | 12/2018 | |
| WO | WO-2020240363 | A1 * | 12/2020 | D04B 15/14 |

OTHER PUBLICATIONS

Written Opinion dated Sep. 11, 2020 in corresponding International Application No. PCT/IB2020/054838, 11 pages.

* cited by examiner

FIG.4
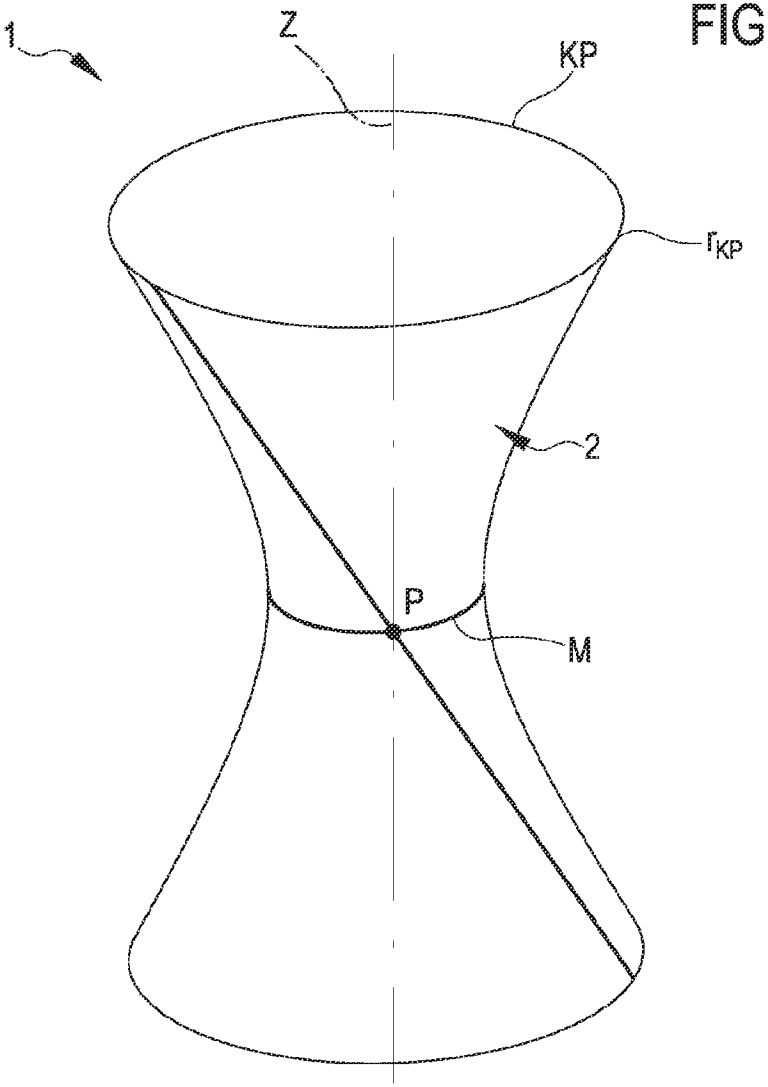
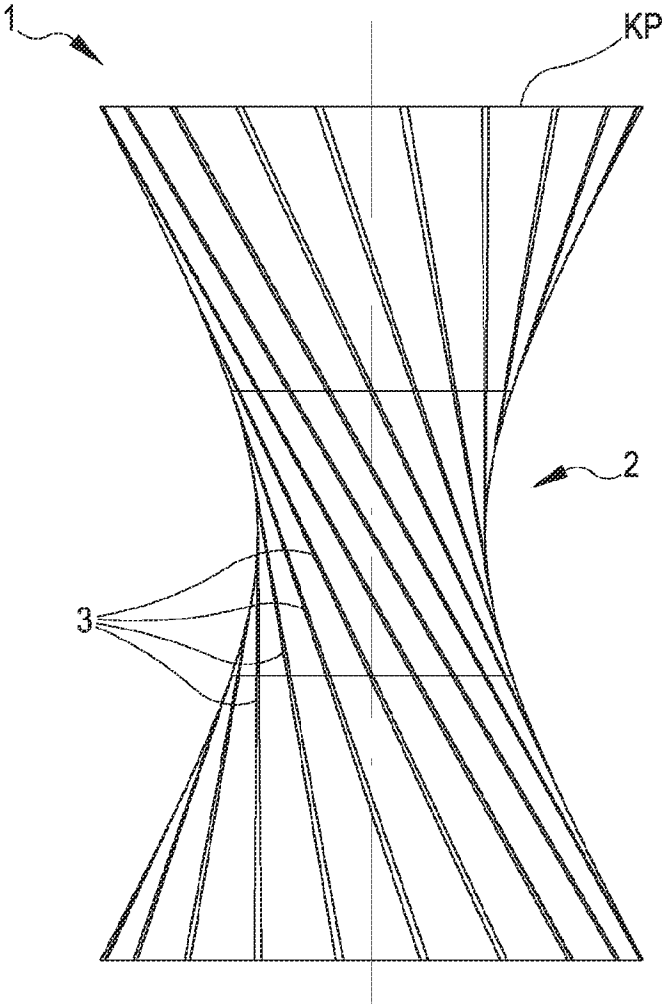
FIG.3

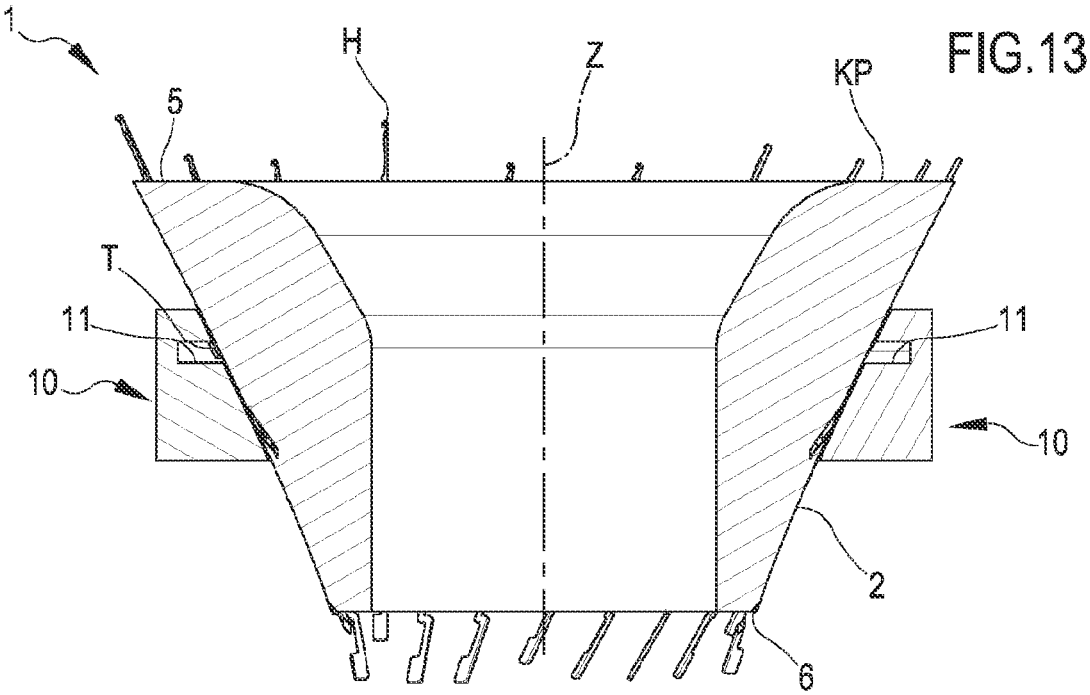
FIG.13
FIG.14
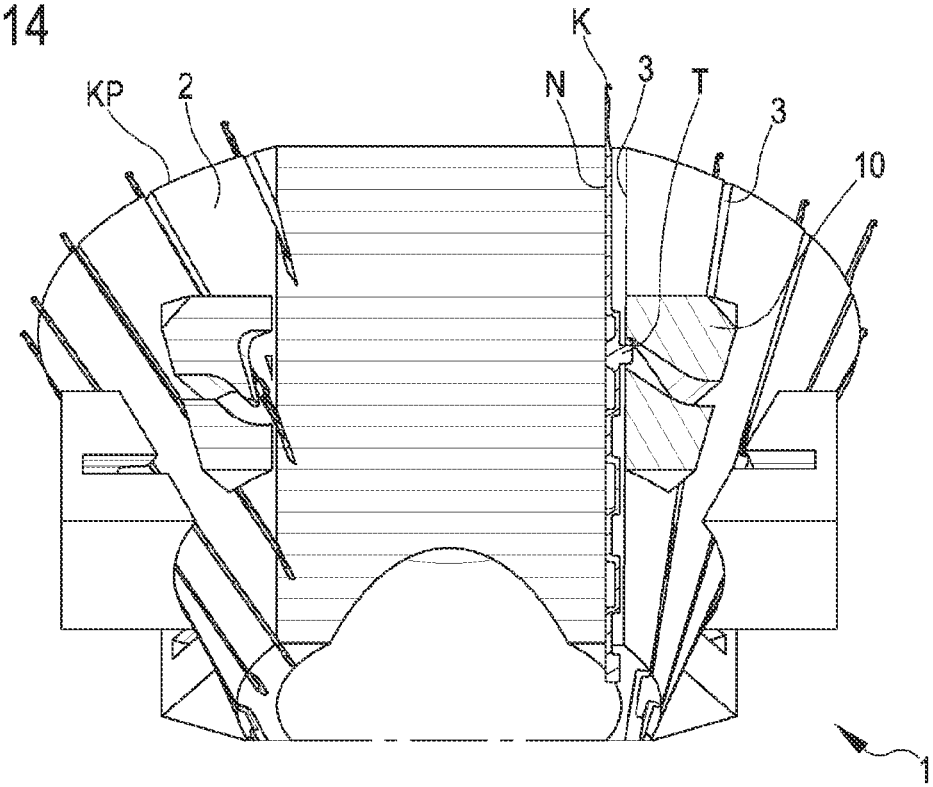

NEEDLE-HOLDING UNIT FOR A CIRCULAR KNITTING MACHINE

CROSS-REFERENCE TO RELATED APPLICATIONS

This application is a U.S. National Stage application of PCT/IB2020/054838 filed May 21, 2020, pending, which claims priority to Italian Patent Application No. 102019000007380 filed May 27, 2019, the entire disclosures of which are hereby incorporated by reference in their entireties.

FIELD OF THE INVENTION

The present invention relates to a needle-holding unit for a circular knitting machine and to a circular knitting machine comprising this unit.

In particular, the present invention relates to a needle-holding cylinder or a needle-holding plate designed to be introduced into a knitting machine and characterized by a specific structure of its seats apt to house the needles of the knitting machine. The present invention can further relate to a circular knitting machine comprising a needle-holding unit, having a specific structure, and further components such as control units, needles, etc.

The present invention falls into the technical field of circular knitting machines for knitted items, seamless knitted items, hosiery items and the like.

In the present text the words "knitting machine" generally means a circular knitting machines apt to manufacture knitted items and provided with at least one needle-holding unit, i.e. with a needle-holding cylinder or plate, turnably mounted in a frame of the machine and supporting a plurality of needles moving so as to produce a knitted fabric. Moreover, the knitting machine is provided with a plurality of yarn feeding points or yarn "feeds", in which the needles of the machine are supplied with yarn. This knitting machine can be e.g. single or double needlebed. Circular knitting machines can comprise a variable number of feeds, e.g. 4, 6, 8 or more yarn feeds.

BACKGROUND OF THE INVENTION

As is known, circular knitting machines for knitted items are provided with stitch forming units generally comprising: a needle-holding cylinder and/or a needle-holding plate, actuating cams, needles, etc.

The knitted fabric is produced by rotating the needle-holding cylinder and/or the needle-holding plate around an axis of rotation.

As far as the needle-holding cylinder is concerned, the needles are arranged vertically on the outer surface of the cylinder, in dedicated seats suitably shaped to house them. Conversely, as far as the needle-holding plate is concerned, the needles are inserted onto the upper face thereof, in seats having a radial direction with respect to the axis of rotation of the knitting machine. The sliding direction of the needles corresponds to a straight line along which the motion of the needles working inside the respective seat occurs: this sliding direction is vertical and parallel to the axis of rotation of the machine for needles belonging to the cylinder, whereas it is horizontal and radial with respect to the axis of rotation of the machine for the needles belonging to the plate.

In order to move the needles along the respective sliding direction, cams (referred to as "stitch cams") are used, provided with a profile that is able to interact with suitable needle butts so as to control the movement of the needles in the respective needle seat. This movement occurs at least from a first position, in which the produced stitch gets under the needle latch, to a second position, in which the needle—after taking the yarn—gets under the holding-down plane for forming new knitted fabric. The butt of a needle getting inside the "path" defined by the stitch cam makes the needle move between the aforesaid first and second position for making knitted stitches.

Basically, the stitch cam—thanks to its profile—makes the needle rise above the stitch forming plane so that the stitch already produced gets under the needle latch and the needle head takes new yarn, and then sink—with the new yarn—to a level below the holding-down plane.

The total travel of the needle depends on various parameters and highly affects the geometry of the stitch cam. As a matter of fact, in order to obtain a given law of motion for the needle (i.e. a desired movement of the needle, during rotation, along its sliding direction) it is necessary to suitably profile the stitch cam (in which the butts slide).

The stitch cams actuate the needle butts by means of a generally closed "path", i.e. defined above and below, with an angle of pressure varying instant by instant. The wording "angle of pressure" means the angle formed for each point of the stitch cam by the direction of motion of the needle but (i.e. by the horizontal direction imparted by the cylinder rotation) with the inclination or slope on every point of the stitch cam itself (i.e. with the tangent to the cam surface). As an alternative, by convention, the angle of pressure can be considered as the complementary angle to the angle formed by the needle axis and the profile slope, i.e. 90°-angle between needle and cam profile. It is obvious that the steeper the cam profile, the greater the angle of pressure.

Among the various factors affecting the stitch cam shape, one of the most relevant is fineness. The fineness of a knitting machine indicates the distance between two adjacent needles. In the stitch forming point, the yarn must not be subjected to too high tensions since otherwise it would be likely to break.

The vertical distance between the stitch forming plane and the point of maximum sinking of the needle varies as a function of fineness: as a result, systems for adjusting cams which allow to move them vertically are known. In general, it is not possible to reduce the value of the aforesaid distance below a given value, since a given sinking is required for ensuring the correct formation of knitted stitches. For instance, in high fineness, single needlebed machines it can be necessary for the sinking value to be at least of 0.7-0.8 mm, due to the minimum size that can be obtained for the hooks (or heads) of the needles: as a matter of fact, should the needles not sink below the holding-down plane—by means of the stitch cams—at least of such a value, it would not be possible to cast off the hooks the old stitch and it would not therefore be possible to correctly produce a knitted fabric.

Therefore, after defining a minimum vertical distance, as the fineness increases the number of engaging needles increases (i.e. adjacent needles included in a stitch cam); that is why the stitch cam profile—from a theoretical point of view—should have an inclination which increases as fineness increases (i.e. as the needle distance). However, in the field of circular knitting machines it is known that the maximum angle of pressure currently applicable to a stitch cam, in particular during the sinking step, is of about 55°. Higher values of the pressure value (i.e. higher slopes of the stitch cam) can cause the butts of the moving needles to break, since the high inclination of the cam profile makes it difficult for the needle to slide in its seat due to the friction between needle and seat, which can lead to needle blocking and as a result to butt breaking in the stitch cam. Moreover, the needle butts can sometimes bend and deviate from the vertical line as a result of the applied forces: this bending, if the slope of the stitch cam profile is high, can cause the butt to block inside the cam and therefore to break.

In recent years the market of knitting machines has required higher and higher finenesses, which means a smaller and smaller distance between the needles.

In a machine with high fineness, the need to ensure a minimum sinking value of the needle under the holding-down plane and at the same time the impossibility of having too high a angle of pressure (i.e. the impossibility of sinking with too steep a cam profile) result in the presence, instant by instant, of a large number of needles, all of them lying below the holding-down plane. The large number of needles results in an increase of tension on the yarns. It is therefore not possible to increase fineness or the rotational speed of the needle-holding unit, since the yarn breaks or loses fibers and it is therefore impossible to produce knitted fabric. In addition, the increase of tension collides with the decrease of the maximum tension that can be tolerated by extremely thin yarns used for high finenesses.

SUMMARY

In the light of the above, it is manifest that the design and production of knitting machines should take into account several constraints. In particular, the definition of the law of motion for the needles is subject to strong limitations due to the limits of cam profiling.

Under these circumstances, the production of circular knitting machines with high fineness is particularly complex. Known solutions cannot go beyond given fineness values and reach higher performance, since serious drawbacks occur, such as needle butt breaking and/or yarn breaking.

The Applicant has further verified that known stitch cams typically have a "symmetrical" shape, i.e. they have a rising portion followed by a sinking portion, these two portions having similar slopes (as absolute values) and therefore developing for similar lengths; this is due to the need to limit the angle of pressure in order to avoid too high mechanical efforts. Therefore, basically the length of the stitch cam is substantially divided in equal parts between the rising portion (where the previous stitch is cast off) and the sinking portion (where the new stitch is loaded). However, considering things from the textile point of view (i.e. without taking into account mechanical limitations), it would be desirable to carry out an "asymmetrical" cam, i.e. a cam having a rising portion (i.e. where the old stitch is cast off) with low steepness, followed by a highly steep sinking portion (new stitch loaded). The reason for this is that, as pointed out above, the highest efforts on the yarns occur in the stitch cam portion related to step in which the stitch is created, i.e. during the sinking step. Therefore, a steep sinking would enable to reduce the number of engaging needles (i.e. engaging the yarn) in the sinking portion of the cam, and thus to reduce tension on the yarns. However, as explained above, this is not possible since a steep sinking would have angles of pressure above 55°, which constitutes a mechanical limit above which the needle butts break.

Eventually, the Applicant has found that known solutions are not without drawbacks and can be improved under various aspects.

Under these circumstances, the aim underlying the present invention in its various aspects and/or embodiments is to provide a needle-holding unit for circular knitting machines and a circular knitting machine comprising such a unit, which can obviate one or more of the drawbacks referred to above.

Another aim of the present invention is to create alternative solutions to known technique for carrying out needle-holding units for circular knitting machines and/or open new design possibilities.

Another aim of the present invention is to provide a needle-holding unit for circular knitting machines which can enable the definition of advanced laws of motion for the needles, and in particular control as desired the movement transferred to the needles, without the limits that are typical of prior art solutions.

Another aim of the present invention is to provide a needle-holding unit for circular knitting machines which can enable a new design of the stitch cams cooperating with this unit.

Another aim of the present invention is to provide a needle-holding unit for circular knitting machine which can open new possibilities for carrying out stitch cams.

Another aim of the present invention is to provide a needle-holding unit for circular knitting machines which can enable to increase the performance of a knitting machine, and in particular to increase the fineness of the knitting machine (e.g. up to values of 60, 90 or above).

Another aim of the present invention is to provide a needle-holding unit for circular knitting machines characterized by a high operating reliability and/or by a lower susceptibility to failures and malfunctions, in particular for high finenesses and/or for high operating speeds.

Another aim of the present invention is to provide a needle-holding unit for circular knitting machines which can enable to reduce or eliminate the breaking of the butts of the needles cooperating with the stitch cams.

Another aim of the present invention is to provide a needle-holding unit for circular knitting machines which can enable to reduce or eliminate the breaking of yarns, in particular with high finenesses.

Another aim of the present invention is to provide a needle-holding unit for circular knitting machines characterized by a simple and rational structure.

Another aim of the present invention is to provide a needle-holding unit for circular knitting machines characterized by an innovative structure and configuration of the needle seats.

A further aim of the present invention is to provide a needle-holding unit for circular knitting machines characterized by low manufacturing costs as far as offered performance and quality are concerned.

These and other possible aims, which shall appear better from the following description, are basically achieved by a needle-holding unit for circular knitting machines and by a circular knitting machine comprising such a unit according to one or more of the appended claims, each one being considered alone (without those depending on it) or in any combination with the other claims, and according to the following aspects and/or embodiments, variously combined, also with the aforesaid claims.

In a first aspect thereof, the invention relates to a needle-holding unit for circular knitting machines, designed to be turnably mounted to a supporting structure of a circular knitting machine and having a structure basically shaped as a hollow solid of rotation developing around a central axis, the needle-holding unit being configured for turning around said central axis and for supporting a plurality of needles moving so as to produce a knitted fabric, the needle-holding unit having on an outer side thereof at least one working surface.

In one aspect, a plurality of needle seats placed one beside the other and arranged around said central axis is defined on the working surface.

In one aspect, each one of said needle seats is configured for movably housing at least one portion of at least a respective needle to be actuated with an alternate motion along the respective needle seat.

In one aspect, said alternate motion comprises a motion of extraction, by which the needle is taken out with its head and with a portion of its stem above of the needle-holding unit through an upper end of the respective needle seat so as to discharge on its stem the knitted loop previously formed and/or for taking the yarn or yarns supplied on a machine feed, and with a motion of return, so as to form a new knitted loop by holding down the knitted loop previously formed, in order to produce knitted fabric.

In one aspect, in said motion of return the needle is returned with its head into the respective needle seat.

In one aspect, the needle-holding unit is equipped above with a knitting plane which the upper ends of the needle seats point towards, destined to receive resting thereon the knitted portions between two adjacent needles while these, after taking the yarn from a machine feed, get back into the respective needle seats.

In one aspect, each needle seat has a longitudinal development inclined with respect to the central axis.

In one aspect, the working surface has a shape as a surface of rotation obtained through the rotation of said needle seat around the central axis.

In one aspect, said working surface is a non-cylindrical three-dimensional surface. In one aspect, said working surface is a non-conical three-dimensional surface.

In one aspect, each of said needle seats has a mainly one-dimensional development, along a direction corresponding to its height and coinciding with said longitudinal development of the needle seat on the working surface. In one aspect, said longitudinal development of the needle seat is larger than its width and depth, which are sized so as to movably house at least one respective needle.

In one aspect, said longitudinal development of the needle seat is similar to a segment of a straight line.

In one aspect, the technical feature according to which the working surface is a surface of rotation obtained through the rotation of the needle seat around the central axis means that the surface of rotation is obtained by a rotation of the longitudinal development, considered from a two-dimensional point of view as a segment corresponding to its length.

In one aspect, said working surface is a one-sheeted hyperboloid or hyperbolic hyperboloid.

In one aspect, said working surface is a ruled surface, preferably a doubly ruled surface, and in particular a non-degenerate quadric.

In one aspect, said working surface is a concave surface, developing all around the central axis, the concavity pointing outside the needle-holding unit.

In one aspect, the working surface is a portion of an ellipsoid, e.g. a scalene ellipsoid, a prolate spheroid, an oblate spheroid or a sphere.

In one aspect, the working surface is a portion of a paraboloid, e.g. an elliptic paraboloid, a circular paraboloid or a hyperbolic paraboloid.

In one aspect, said working surface is a two-sheeted hyperboloid or elliptic hyperboloid.

In one aspect, the working surface is not a degenerate quadric.

In one aspect, the distance from the central axis, calculated on planes parallel to the horizontal plane, of each point of the working surface varies for each vertical height, along a direction parallel to the central axis, preferably in a non-linear manner.

In one aspect, the working surface has an upper end and a lower end, between which a central section is placed, and the distance from the central axis, calculated on planes parallel to the horizontal plane, of the points belonging to the upper end and to the lower end is larger than the distance of the points belonging to the central section.

In one aspect, as an alternative to the previous one, the working surface has an upper end and a lower end, and the distance from the central axis, calculated on planes parallel to the horizontal plane, of the points belonging to the upper end is larger than the distance of the points belonging to the lower end.

In one aspect, as an alternative to the two previous ones, the working surface has an upper end and a lower end, and the distance from the central axis, calculated on planes parallel to the horizontal plane, of the points belonging to the lower end is larger than the distance of the points belonging to the upper end.

In one aspect, the working surface defines a minimum circumference lying on a plane parallel to the horizontal plane and comprising all of its points having a minimum radial distance from the central axis.

In one aspect, said minimum circumference of the working surface can coincide with said upper end or with said lower end.

In one aspect, the difference between the radial position, i.e. the distance from the central axis, of the points of the working surface lying on the upper end or on the lower end of the working surface, and the radial position of the points of the working surface lying on the minimum circumference of the working surface is of at least 0.1 mm and/or of at least 1 mm and/or of at least 2 mm and/or of at least 10 mm.

In one aspect, the variation between the radial position, i.e. the distance from the central axis, of the points of the working surface lying on the upper end or on the lower end of the working surface, and the radial position of the points of the working surface lying on the minimum circumference of the working surface is of at least 1% and/or of at least 2% and/or of at least 5% and/or of at least 10%.

In one aspect, the intersection between a plurality of planes parallel to the horizontal plane, each at a different vertical height along the vertical axis, and the surface of said working surface identifies a plurality of horizontal circumferences, each circumference being defined by all of the points of the working surface placed at the respective height of the circumference itself and at a distance from the central axis corresponding to the radius of the circumference itself.

In one aspect, each needle seat is configured for housing at least one respective needle having a rectilinear shape, and has a bottom surface of the seat (or bottom) on which said at least one respective needle slides.

In one aspect, said needle seat being inclined with respect to the central axis, the bottom surface of the seat has a point of minimum distance from the central axis and lies on a bottom plane, said bottom plane being parallel to the central axis and tangent to a base cylinder of the needle-holding unit.

In one aspect, the bottom plane is tangent to the base cylinder in a segment of contact, which is vertical and parallel to the central axis, said segment of contact comprising (i.e. traversing) said point of minimum distance.

In one aspect, said minimum distance corresponds to a minimum radius of the working surface, corresponding to the radius of said base cylinder.

In one aspect, the combination of the inclination of the needle seat with the three-dimensional shape of the working surface is such as to define a linear bottom, lying on the respective bottom plane, tangent to the base cylinder.

In one aspect, the base cylinder is the one obtained with a radius corresponding to the minimum radius of the working surface, having a shape as a hyperbolic hyperboloid.

In one aspect, the working surface comprises at least all the points belonging to all the needle seats.

In one aspect, said needle seat has an inclination with respect to the central axis corresponding to an angle of inclination different from zero, said angle of inclination being the smallest angle formed by each needle seat, on the bottom plane, with the respective segment of contact.

In one aspect, the needle-holding unit comprises control devices associated thereto, arranged outside around the needle-holding unit preferably, during use, in a stationary manner and configured for interacting with the needles supported by the needle-holding unit, as a result of the relative rotation between the needle-holding unit, rotating around the central axis, and the stationary control devices, so as to transmit a controlled movement to each needle within the respective needle seat, and to cause a movement of the heads of the needles according to a law of motion.

In one aspect, said law of motion describes the position of the heads as a function of the angle of rotation of the needle-holding unit with respect to the central axis.

In one aspect, the position of the heads determined by said law of motion follows, during the rotation of the needle-holding unit around the central axis, a non-cylindrical, three-dimensional path, whose coordinates may vary both in height, along a direction parallel to the central axis, and horizontally, with respect to the knitting plane, getting away from or towards the central axis during the rotation of the needle-holding unit.

In one aspect, the horizontal position of the heads involves a larger distance from the central axis the higher their vertical position (calculated as an absolute value of the distance from the point of minimum distance P), and conversely, the horizontal position of the heads involves a smaller distance from the central axis the lower their vertical position (calculated as an absolute value of the distance from the point of minimum distance P).

In one aspect, the height (vertical position) reached by the head also depends on its radial component, which varies as a function of height but, since the needles always move on the plane of the bottom (tangent to the base cylinder and parallel to the central axis), the radial component (i.e. on the horizontal plane) of the trajectory of the heads is related to height and to parameters characterizing the geometry of the needle-holding unit (in particular the inclination of the inclined seat).

In one aspect, each needle of said plurality of needles comprises at least one respective butt configured for engaging said control devices.

In one aspect, said control devices comprise a plurality of cams configured for interacting, by means of a respect cam profile or path, with the needle butts, so as to control the ascending and descending motion of each needle inside the respective needle seat, according to the aforesaid law of motion.

In one aspect, the cam profile or path of each cam develops on a non-cylindrical, non-conical three-dimensional cam surface.

In one aspect, the three-dimensional shape of the working surface of the needle-holding unit cooperates with the cam profiles or paths of said plurality of cams in defining said law of motion.

In a possible embodiment, the needles can be taken out of the needle-unit with said angle of inclination.

In one aspect, each needle seat has a main longitudinal development and is configured for laterally containing inside, at least partially, said at least one respective needle, so that the needle can slidably move in the needle seat following said longitudinal development of the seat itself, and wherein the needle seat is configured for slidably housing at least one portion of a respective needle comprising the butt of the needle itself.

In one aspect, said angle of inclination is preferably between 0° and 90°.

In one aspect, the needle seat has a rectilinear shape corresponding to its longitudinal development.

In one aspect, the needle seat is inclined with respect to the central axis so as to lie at the back along a direction of rotation, during use, of the needle-holding unit.

In one aspect, said plurality of needle seats comprises needle seats that are identical to one another and all have the same angle of inclination.

In one aspect, the needle seat is rectilinear and develops in a respective unitary direction of development, which is transversal with respect to the central axis and lies on the respective bottom plane.

In one independent aspect thereof, the present invention relates to a circular knitting machine for knitted or hosiery items, comprising:

a supporting structure;

at least one needle-holding unit according to one or more of the aforesaid aspects and/or claims, having a structure basically shaped as a hollow solid of rotation developing around a central axis, the needle-holding unit being turnably mounted in said frame so as to turn around said central axis;

a plurality of needles movably introduced into the needle seats of the needle-holding unit and moving so as to produce a knitted fabric, wherein each needle seat houses at least one respective needle, each needle comprising at least one respective butt and one respective head.

In one aspect, the knitting machine comprises a plurality of needle control devices or "stitch cams", configured for interacting with the needles, in particular with the needle butts, so as to transmit to the needles a given movement inside the respective needle seat during the rotation of the needle-holding unit.

In one aspect, each needle control device or "stitch cam" comprises a respective cam path configured for blocking the butts of the needles in rotation with the needle-holding unit, so that the needle butts enter said cam path and are guided according to a given law of motion so as to make a given sliding movement inside the respective needle seat.

In one aspect, each point of said cam path has a respective slope corresponding to the angle complementary to the smallest angle formed by a straight line tangent to said point of the path with a straight line passing through said point and parallel to the central axis.

In one aspect, at least one portion of the cam path has points with a slope above 50° and/or above 60° and/or above 70° and/or above 80°. In one aspect, said slope can take values of about 90° or above 90°.

In one aspect, the cam path of said needle control device has a non-cylindrical, three-dimensional or globoidal shape, such as to be basically matching and facing said working surface of the needle-holding unit, in order to interact with the butts of the needles during the rotation of the needle-holding unit.

In one aspect, for each point of its angular extension around the needle-holding unit, said cam path exhibits:

- a height corresponding to the height of the path point, calculated in a direction parallel to the central axis;
- a radial coordinate corresponding to the distance of the point from the central axis.

In one aspect, the law of motion of the heads of the needles is determined by a combination of the geometrical features of the working surface of the needle-holding unit and of the geometrical features of the cam surfaces on which the cam paths of said plurality of needle control devices develop.

Each one of the aforesaid aspects of the invention can be considered alone or in combination with any one of the claims or of the other aspects as described.

Further characteristics and advantages shall be more evident from the detailed description of some embodiments, among which also a preferred embodiment, which are exemplary though not exclusive, of a needle-holding unit for circular knitting machines and of a knitting machine comprising such a unit, according to the present invention.

DESCRIPTION OF THE DRAWINGS

This description shall be made below with reference to the accompanying drawings, provided to a merely indicative and therefore non-limiting purpose, in which:

FIG. 3 is a further representation of the solids of FIG. 1;

FIG. 4 shows a front view of the solid of FIG. 2, where a needle seat is highlighted schematically, configured for movably housing at least a respective needle;

FIGS. 13 and 14 are sectioned view, along plane XIII-XIII and along plane XIV-XIV, respectively, of the needle-holding unit of FIG. 12;

DETAILED DESCRIPTION

Figure 2:
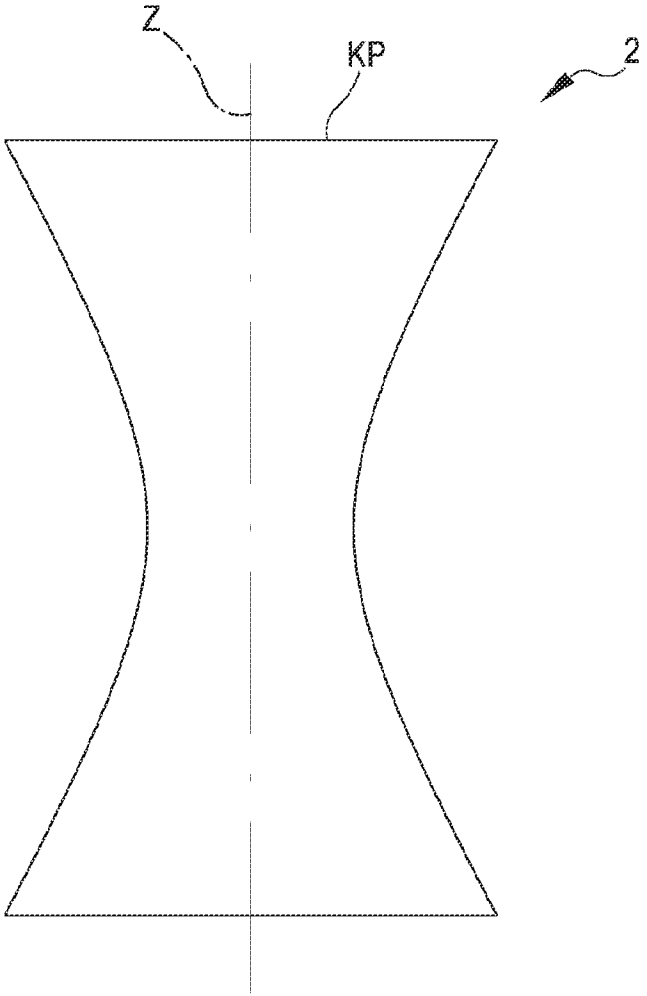
FIG. 2 shows a geometrical front representation of a solid of rotation shaped as a one-sheeted hyperboloid or hyperbolic hyperboloid.

With reference to the mentioned figures, the numeral 1 globally designates a needle-holding unit for circular knitting machines according to the present invention. Generally, the same numeral is used for identical or similar elements, if applicable in their variants of embodiment.

The needle-holding unit 1 according to the present invention is designed to be introduced into a circular knitting machine for knitted items or seamless knitted items or for hosiery items. In further detail, the needle-holding unit 1 is designed to be mounted in a circular knitting machine comprising at least:

- a supporting structure (or frame);
- the needle-holding unit itself, turnably mounted to the frame so as to rotate around a central axis;
- a plurality of needles supported by the needle-holding unit and moving so as to produce a knitted fabric;
- a plurality of yarn feeding points or yarn "feeds", in which the needles of the machine are supplied with yarn, the feeds being placed circumferentially around the needle-holding unit and angularly spaced one from the other.

The figures do not show the knitting machine for which the needle-holding unit is designed; such a machine can be of conventional type and known per se.

From the point of view of knitting technology, the operation of the whole knitting machine is not described in detail, since it is known in the technical field of the present invention.

The needle-holding unit 1 has a structure basically as a hollow solid of rotation (or revolution) developing around a central axis Z, and is configured for rotating around this central axis and for supporting a plurality of needles N moving so as to produce a knitted fabric. In the present text, the wording "needle-holding unit" designate "needle-holding cylinders" and possibly "needle-holding plates", structures that are known in the field of circular knitting machines.

The needle-holding unit 1 has on an outer side at least one working surface, referred to in the figures, and in the various embodiments, with numeral 2.

A plurality of needle seats 3, placed beside one another and arranged around the central axis Z, is defined on this working surface 2.

Each one of these needle seats 3 is configured for movably housing at least one portion of at least a respective needle N to be actuated with an alternate motion along the respective needle seat with:

- a motion of extraction, by which the needle N is taken out with its head H and with a portion of its stem above of the needle-holding unit 1 through an upper end of the respective needle seat so as to discharge on its stem the knitted loop previously formed and/or for taking the yarn or yarns supplied on a machine feed, and
- a motion of return, by which the needle N is returned with its head H into the respective needle seat 3 so as to form a new knitted loop by holding down the knitted loop previously formed.

The alternate motion of the needle 3 allows to produce knitted fabric.

The needle-holding unit 1 is equipped above with a knitting plane KP which the upper ends of the needle seats 3 point towards. The knitting plane KP is destined to receive resting thereon the knitted portions between two adjacent needles while these, after taking the yarn from a machine feed, get back into the respective needle seats.

As shown in the figures, each needle seat 3 of the aforesaid plurality of needle seats 3 has a longitudinal development inclined with respect to the central axis Z.

The wording "needle seat" designates the housing or groove designed to movably house at least one needle of the knitting machine during operation; in the technical field, this needle seat is also referred to as "sliding seat". The needle seats are therefore structures of the needle-holding unit allowing the latter to support and guide the needles in the movement required for forming the knitted fabric.

The wording "on the working surface a plurality of needle seats is defined" means that the working surface comprises a plurality of needle seats obtained on the surface itself, e.g. by cutting the working surface or applying slats on the working surface. Typically, defining a needle seat consists in carrying out a groove or housing indented from the working surface and apt to house at least one needle. As an alternative, the needle seat can be a housing protruding from the working surface. In general, the needle seat has a suitable depth, along a direction transversal or perpendicular to the working surface, so as to house at least partially a respective needle. Moreover, the needle seat has a width, in a direction orthogonal to the longitudinal development thereof and along the working surface, apt to laterally contain said at least one needle; this width is sufficiently large as to contain the needle thickness.

Within the scope of the present invention, the wording "longitudinal development", referred to a needle seat, means the development in length of the seat on the working surface, i.e. the main development with respect to depth and width. Therefore, considering the three dimensions of a needle seat in space as length, width and depth, the longitudinal development is length.

Within the scope of the present invention, the term "inclined" with respect to the central axis Z means that the needle seat 3 forms an angle differing from zero with respect to a straight line parallel to the central axis and lying on a plane traversing the needle seat itself.

Each needle seat 3 has a main longitudinal development and is configured for laterally containing inside, at least partially, at least one respective needle N, so that the needle can slidably move in the needle seat following the longitudinal development of the seat itself.

In other words, each needle seat 3 has a main one-dimensional development along a direction corresponding to its length and coinciding with the aforesaid longitudinal development. This longitudinal development of the needle seat is larger than its width and depth, which are sized so as to movably house at least one respective needle.

The longitudinal development of the needle seat 3 is therefore similar to a segment of straight line.

As shown in the figures, the working surface 2 has a shape as a surface of rotation obtained through the rotation of the needle seat 3 around the central axis Z. In other words, this means that the surface of rotation 2 is obtained by means of a rotation of the longitudinal development, considered two-dimensionally as a segment corresponding to its length.

The working surface 2 is a non-cylindrical, non-conical three-dimensional surface. In particular, as in the embodiments shown in the figures, the working surface is preferably a one-sheeted hyperboloid or hyperbolic hyperboloid.

According to further formulations and embodiments of the present invention, this working surface 2 is a ruled surface, preferably a doubly ruled surface, and in particular a non-degenerate quadric.

Preferably, the working surface 2 is a concave surface, developing all around the central axis Z, the concavity pointing outside the needle-holding unit 1.

In a possible embodiment, the working surface can be a portion of an ellipsoid, e.g. a scalene ellipsoid, a prolate spheroid, an oblate spheroid or a sphere.

In a possible embodiment, the working surface can be a portion of a paraboloid, e.g. an elliptic paraboloid, a circular paraboloid or a hyperbolic paraboloid.

In a further possible embodiment, the working surface can be a two-sheeted hyperboloid or elliptic hyperboloid. Preferably, the working surface 2 is not a degenerate quadric.

The shape of the working surface 2 is shown by way of example in the figures, in accordance with some embodiments, and in particular in FIGS. 1, 2, 3, 4, 5, 7 and 9.

In these figures the three-dimensional shape as a "one-sheeted hyperboloid" or "hyperbolic hyperboloid" of the working surface 2 can be observed, obtained by rotating an inclined segment (the needle seat 3) around the central axis Z.

For the sake of clarity, the schematic figures show only some needle seats on the working surface, at the same distance from one another at regular intervals. However, the technical solution of the present invention can also be implemented, in a circular knitting machine, with a much larger number of needle seats close to one another.

Preferably, the needle-holding unit 1 is equipped with a Cartesian reference system defined by three mutually orthogonal axes, wherein:

- a first vertical axis Z coincides with said central axis Z;
- a second horizontal axis X and a third horizontal axis Y define a horizontal plane, orthogonal to the first axis Z, traversing the knitting plane KP.

Preferably, the needle-holding unit 1 is equipped with a cylindrical reference system, wherein each point of the working surface 2 may be defined by three coordinates:

- a radial coordinate corresponding to the distance of the point from the central axis Z;
- an angular coordinate corresponding to the angular distance with respect to the origin on the horizontal plane;
- an axial coordinate corresponding to the height of the point, calculated in a direction parallel to the central axis Z, with respect to the horizontal plane.

Preferably, the knitting plane KP of the needle-holding unit lies on the aforesaid horizontal plane or is co-planar therewith.

Preferably, the Cartesian reference system and the cylindrical reference system have the same point of origin.

Preferably, as can be observed in the figures, the distance from the central axis Z, calculated on planes parallel to the horizontal plane, of each point of the working surface 2 varies for each vertical height, along a direction parallel to the central axis, preferably in a non-linear manner.

Figure 1:
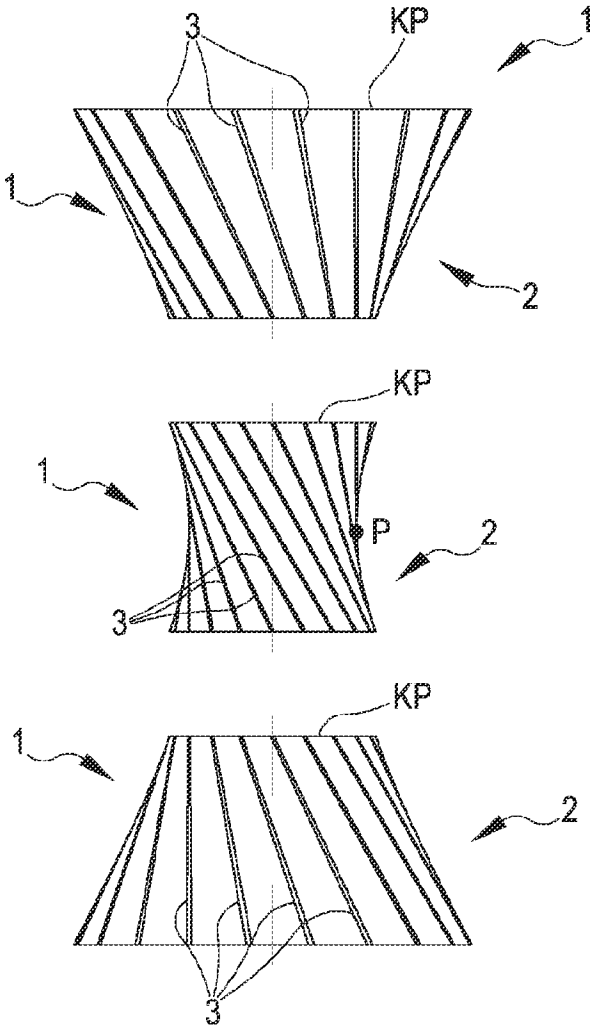
FIG. 1 shows a schematic front view of possible embodiments of needle-holding units for knitting machines, or portions of the same needle-holding unit, according to a possible embodiment in accordance with the present invention.

Preferably, as shown by way of example in FIGS. 1 (in the middle), 3 and 7, the working surface 2 has an upper end 5 and a lower end 6, between which a central section is placed, and the distance from the central axis Z, calculated on planes parallel to the horizontal plane, of the points belonging to the upper end 5 and to the lower end 6 is larger than the distance of the points belonging to the central section.

As an alternative, as shown by way of example in FIGS. 1 (above) and 5, the working surface 2 has an upper end 5 and a lower end 6, and the distance from the central axis Z, calculated on planes parallel to the horizontal plane, of the points belonging to the upper end 5 is larger than the distance of the points belonging to the lower end 6.

As an alternative, as shown by way of example in FIGS. 1 (below) and 9, the working surface 2 has an upper end 5 and a lower end 6, and the distance from the central axis Z, calculated on planes parallel to the horizontal plane, of the points belonging to the lower end 6 is larger than the distance of the points belonging to the upper end 5.

Let's observe FIG. 1: it shows three distinct embodiments of a needle-holding unit 1 according to the present invention (above, in the middle and below). Each of them exhibits a working surface 2 having a three-dimensional shape as a hyperbolic hyperboloid, obtained as a surface of rotation through the rotation of a needle seat 3 having the same inclination as the central axis. Each of the three needle-holding units comprises a respective portion of the same three-dimensional surface as a hyperbolic hyperboloid (represented schematically in FIGS. 2 and 4). In practice, after defining the three-dimensional surface by rotating the needle seat 3 (as in FIG. 4) around the central axis z, a given axial sector of this surface can be selected, i.e. a "slice" of this surface between two horizontal planes, and this sector defines the working surface 2 of a given needle-holding unit.

As an alternative, as shown in the representation of FIG. 3, a needle-holding unit 1 corresponding to the three examples of FIG. 1 taken together can be carried out: in this case the working surface 2 is still a surface as a hyperbolic hyperboloid, consisting of the three working surfaces of FIG. 1 assembled together; the upper end of the needle-holding unit of FIG. 3 corresponds to the upper end of the needle-holding unit above in FIG. 1, whereas the lower end of the needle-holding unit of FIG. 3 corresponds to the lower end of the needle-holding unit below in FIG. 1.

Figure 7:
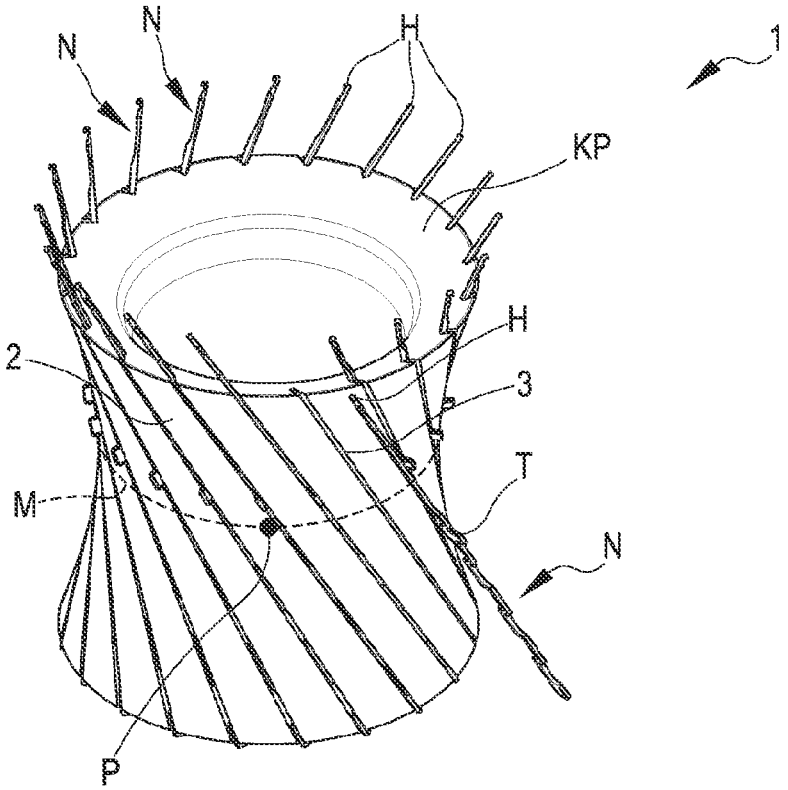
FIG. 7 is a schematic perspective view of a needle-holding unit according to a further possible embodiment of the present invention (corresponding to the central element in FIGS. 1 and 3), provided with a plurality of adjacent inclined needle seats, with a needle in exploded view.

Preferably, as in the embodiments of FIG. 3 and FIG. 7, the working surface 2 defines a minimum circumference M lying on a plane parallel to the horizontal plane and comprising all of its points having a minimum radial distance (referred to as rTAN) from the central axis Z.

Preferably, the difference between the radial position, i.e. the distance from the central axis Z, of the points of the working surface 2 lying on the upper end 5 or on the lower end 6, and the radial position of the points of the working surface 2 lying on the minimum circumference M is of at least 0.1 mm and/or of at least 1 mm and/or of at least 2 mm and/or of at least 10 mm.

Preferably, the variation between the radial position, i.e. the distance from the central axis Z, of the points of the working surface 2 lying on the upper end 5 or on the lower end 6, and the radial position of the points of the working surface 2 lying on the minimum circumference M is of at least 1% and/or of at least 2% and/or of at least 5% and/or of at least 10%.

Preferably, the intersection between a plurality of planes parallel to the horizontal plane, each at a different vertical height along the vertical axis Z, and the working surface 2 identifies a plurality of horizontal circumferences, each circumference being defined by all of the points of the working surface 2 placed at the respective height of the circumference itself and at a distance from the central axis corresponding to the radius of the circumference itself.

Preferably, each needle seat 3 is configured for housing at least one respective needle N having a rectilinear shape, and has a bottom surface of the seat (or bottom) on which said at least one respective needle slides.

Preferably, the needle seat 3 being inclined with respect to the central axis Z, the bottom surface of the seat has a point of minimum distance P from the central axis Z and lies on a bottom plane, said bottom plane being parallel to the central axis Z and tangent to a base cylinder of the needle-holding unit.

Figure 25:
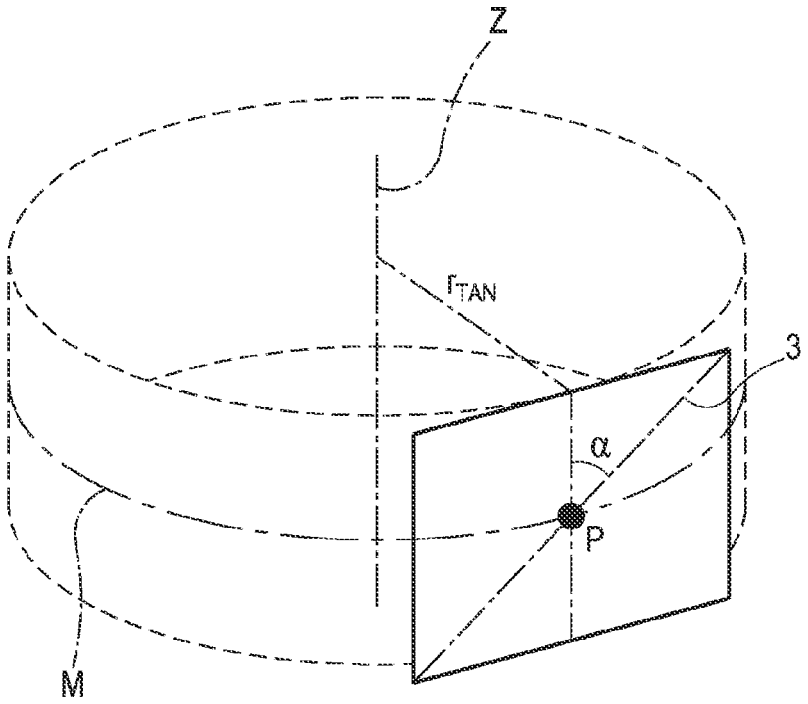
FIG. 25 is a schematic representation of some geometric parameters defining the needle-holding unit according to the present invention.

Let's observe FIG. 25, wherein the base cylinder (in hatched line) is represented schematically, i.e. the ideal cylindrical surface having a radius corresponding to the distance of the point of minimum distance P from the central axis Z (referred to as minimum radial distance, rTAN). The bottom plane is parallel to axis Z and tangent to the base cylinder. The needle seat 3 lies with its longitudinal development on the bottom plane and is tangent to the base cylinder only in point P. Also the angle of inclination a of the needle seat with respect to the vertical line (and thus to the central axis Z) can be observed.

The bottom plane is tangent to the base cylinder in a segment of contact, which is vertical and parallel to the central axis; this segment of contact comprises, i.e. Traverses, the aforesaid point of minimum distance P. The minimum distance corresponds to a minimum radius (rTAN) of the working surface 2, corresponding to the radius of the base cylinder.

Preferably, the needle seat 3 is configured for causing and guiding the sliding of the needle N housed therein on the bottom surface of the bottom plane.

Figure 11:
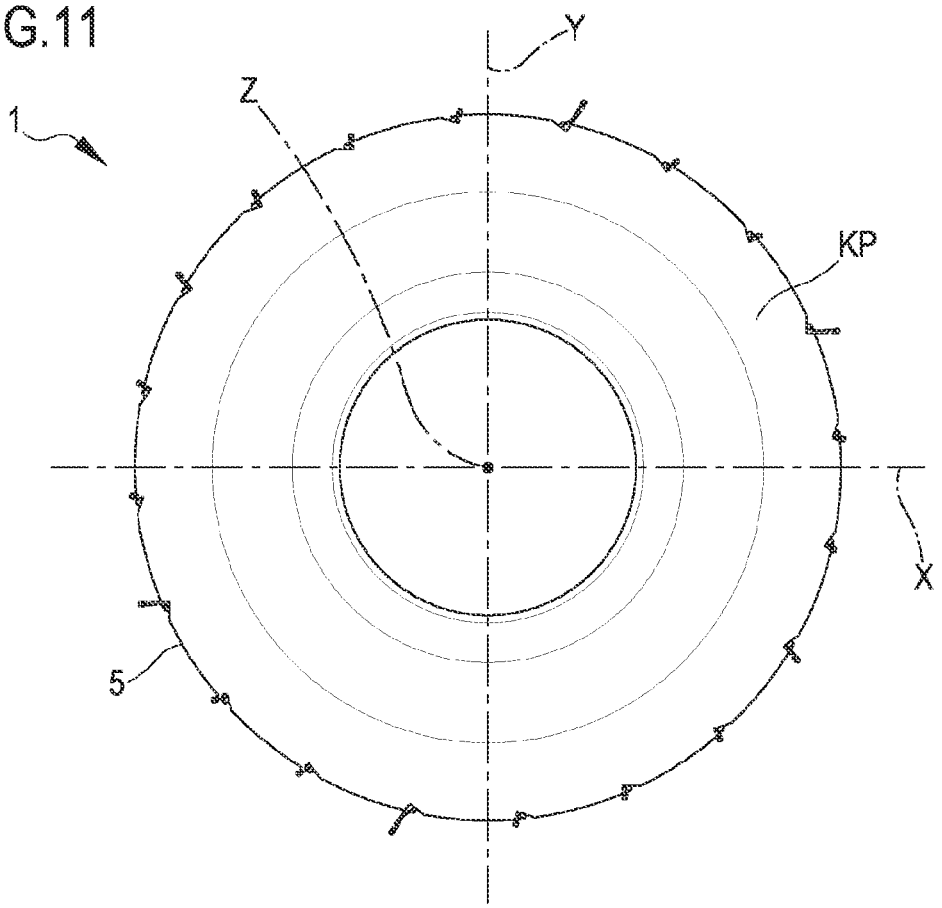
FIG. 11 is a plant view from above of the needle-holding unit of FIG. 5 (note the heads protruding outside)
Figure 12:
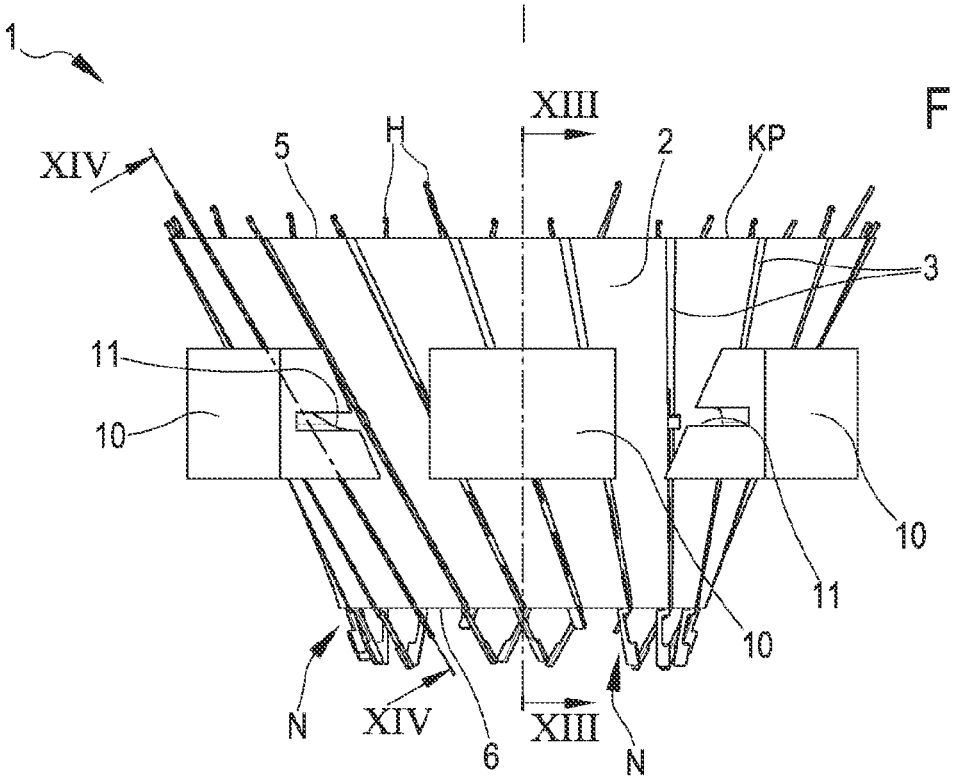
FIG. 12 is a side view of the needle-holding unit of FIG. 11, provided with a plurality of needle control devices, or stitch cams, arranged around it.
Figure 15:
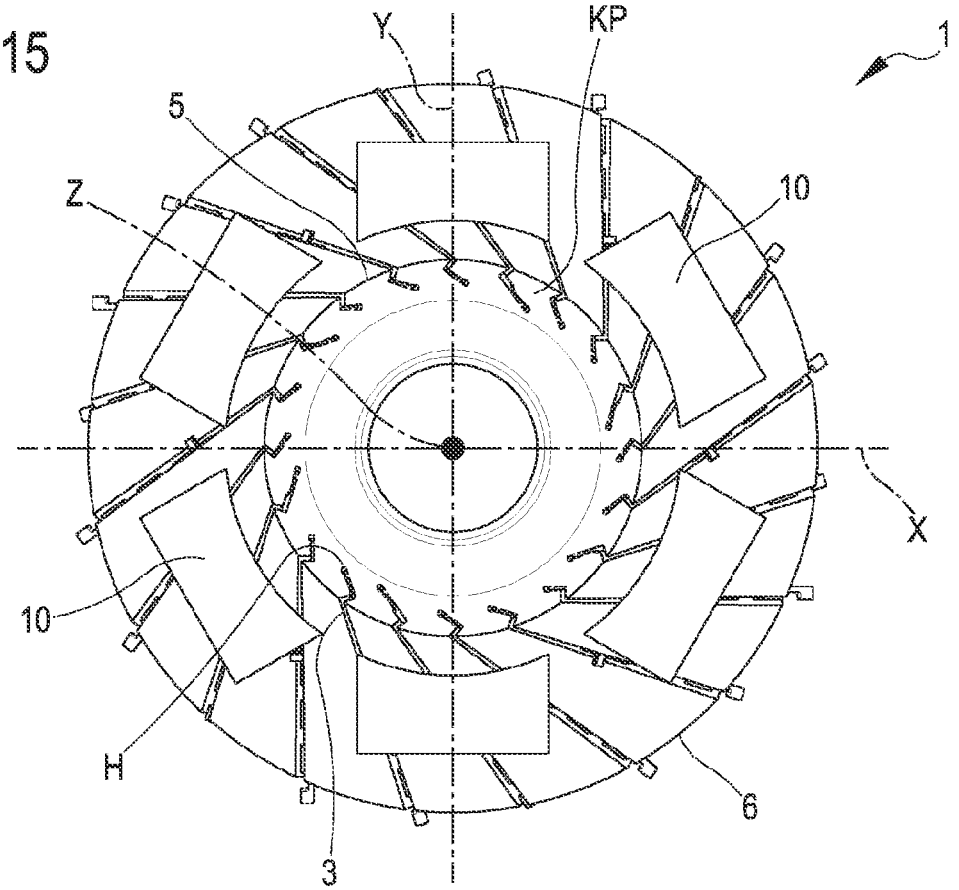
FIG. 15 is a plant view from above of the needle-holding unit of FIG. 9, provided with a plurality of needle control devices, or stitch cams, arranged around it.
Figure 16:
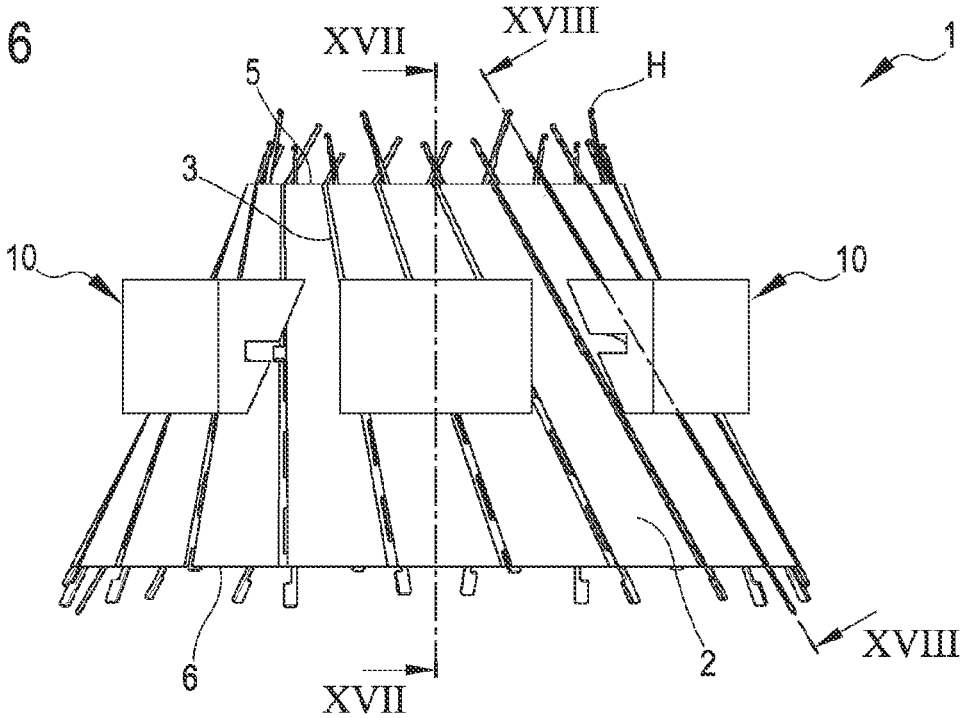
FIG. 16 shows a side view of the needle-holding unit of FIG. 15.
Figure 17:
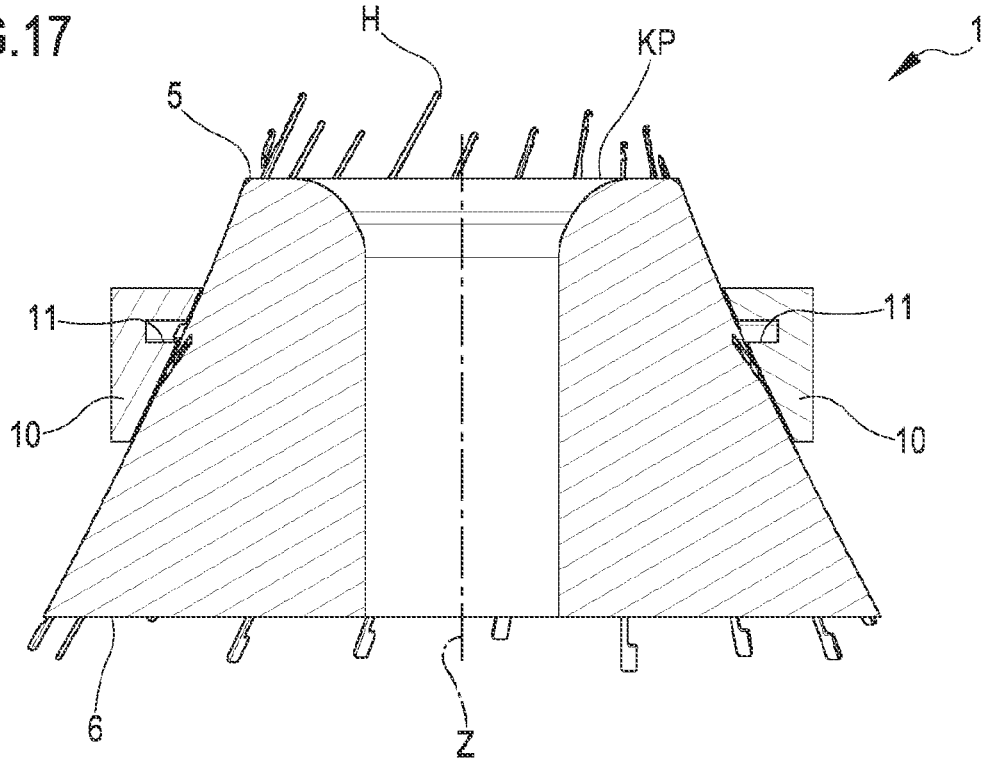
FIGS. 17 and 18 are sectioned views, along plane XVII-XVII and along plane XVIII-XVIII, respectively, of the needle-holding unit of FIG. 16.
Figure 18:
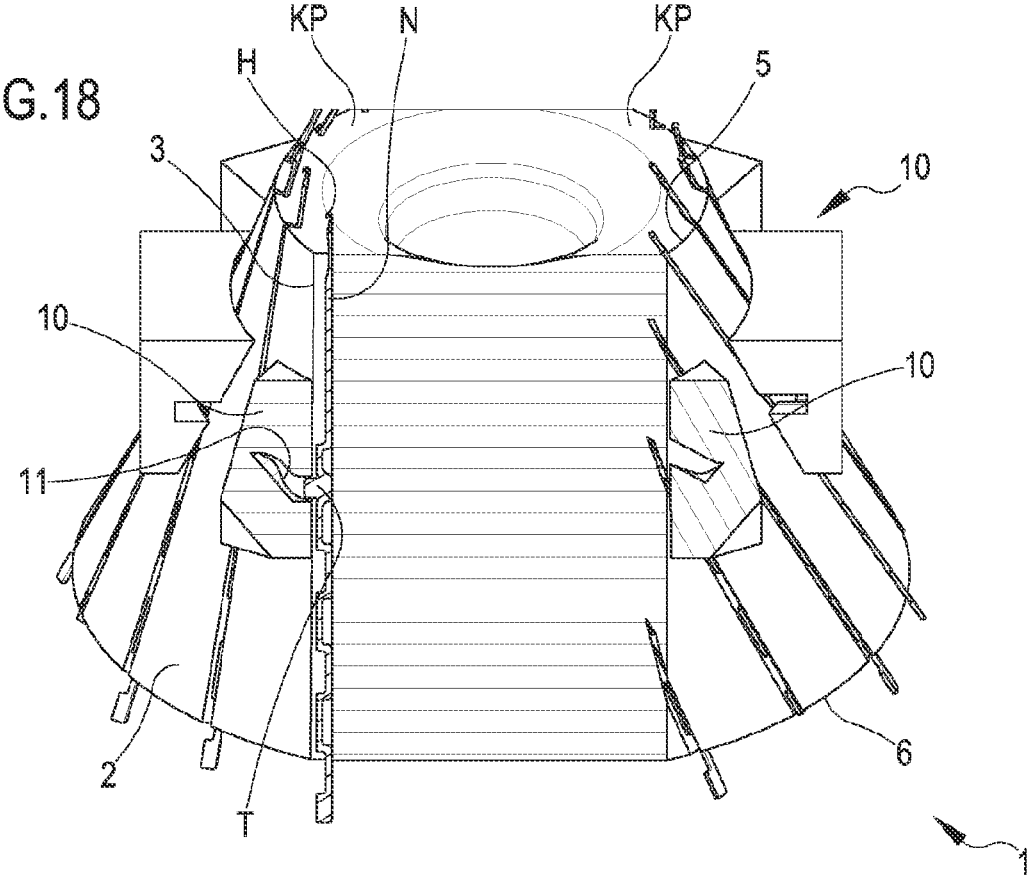
Figure 20:
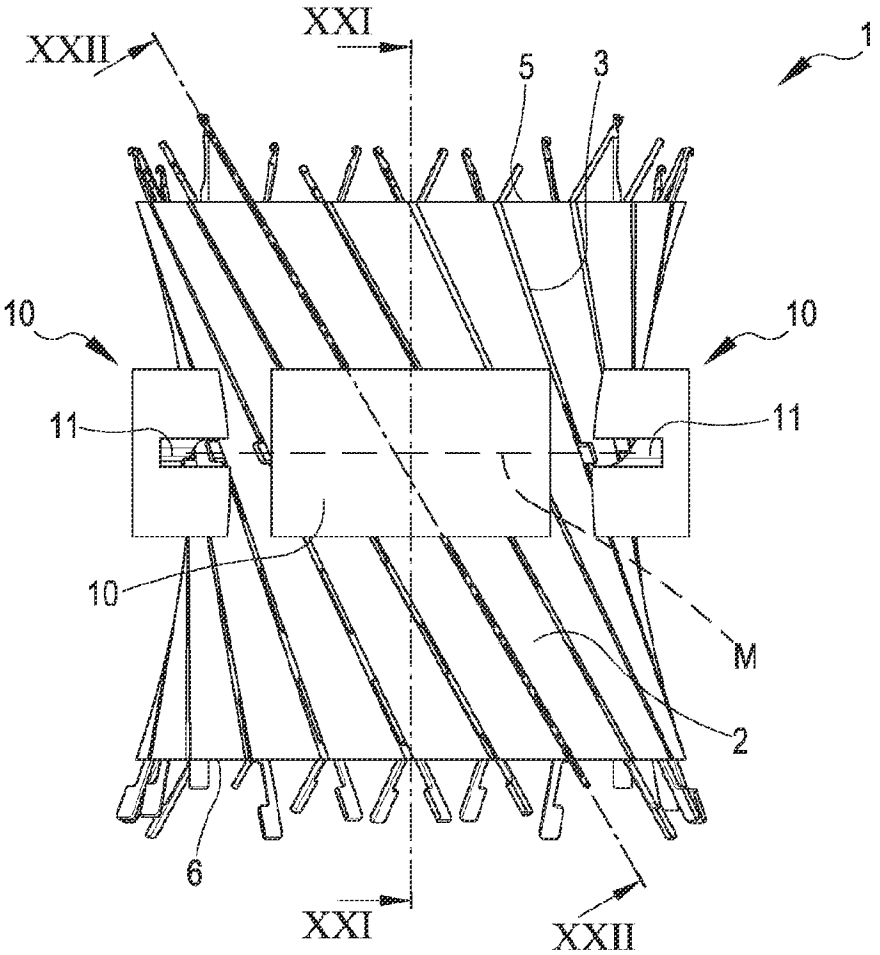
FIG. 20 shows a side view of the needle-holding unit of FIG. 19.
Figure 19:
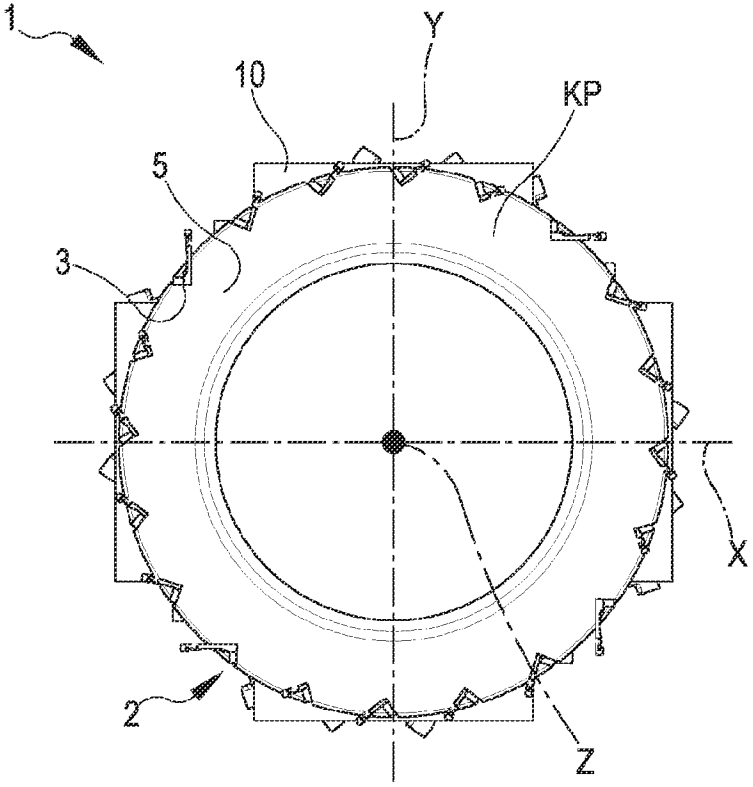
FIG. 19 is a plant view from above of the needle-holding unit of FIG. 7, provided with a plurality of needle control devices, or stitch cams, arranged around it.
Figure 22:
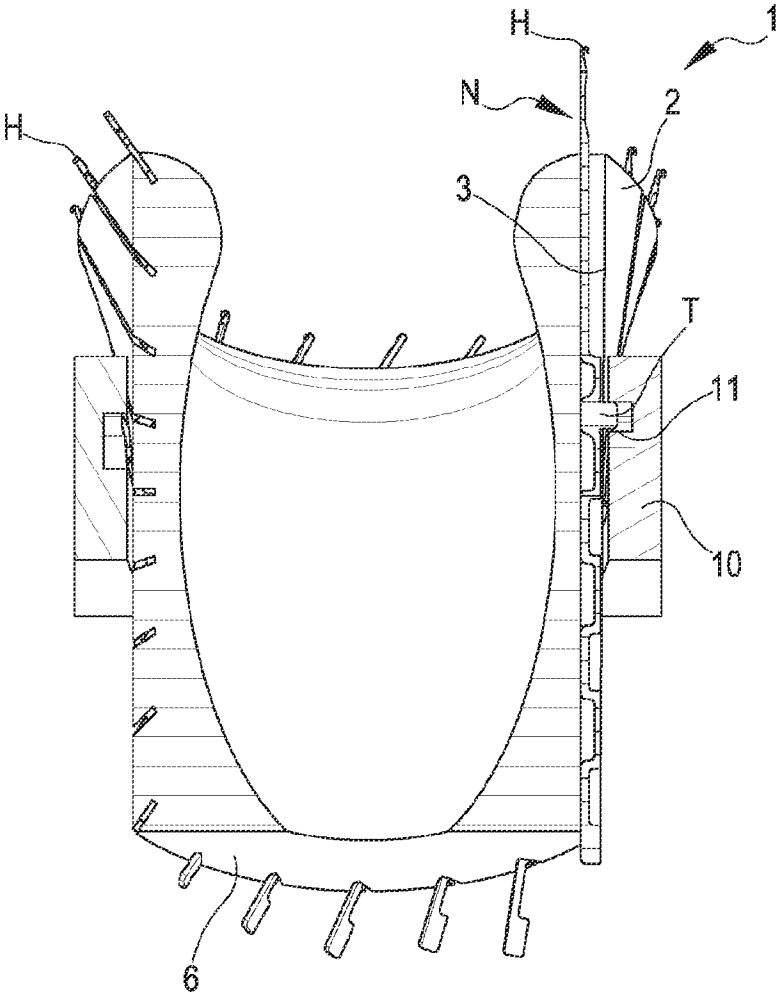
FIGS. 21 and 22 are sectioned views, along plane XXI-XXI and along plane XXII-XXII, respectively, of the needle-holding unit of FIG. 20.
Figure 21:
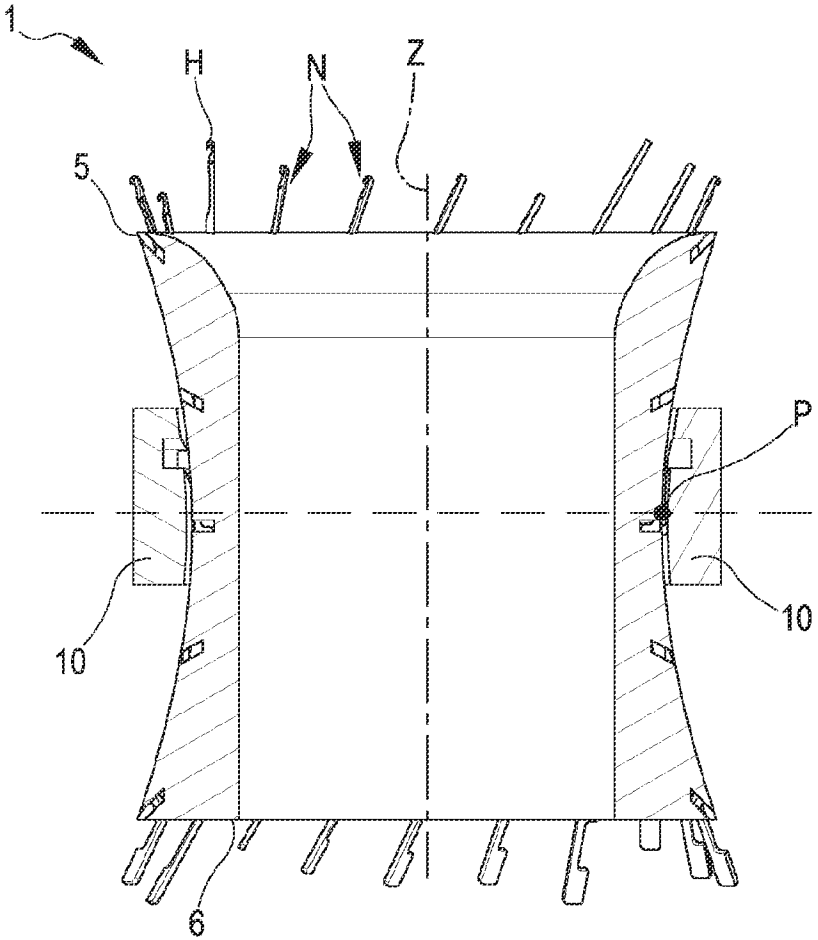

Preferably, as shown in the figures, the combination of the inclination of the needle seat 3 with the three-dimensional shape of the working surface 2 is such as to define a linear and rectilinear bottom, lying on the respective bottom plane, tangent to the base cylinder. This technical feature can be observed in particular in FIGS. 14, 18 and 22. These figures are sections of the needle-holding units according to the embodiments of FIGS. 11, 15 and 19, respectively, and these sections are taken along a needle. It can thus be observed that the needle N is rectilinear and the needle seat 3 and its bottom surface or bottom plane are linear, too.

Preferably, the base cylinder is the one obtained with a radius corresponding to the minimum radius of the working surface, having a shape as a hyperbolic hyperboloid.

Preferably, the envelope of all the needle seats 3 coincides with the working surface 2.

Preferably, the intersection of each vertical plane traversing the central axis Z with the working surface 2 identifies two branches of a hyperbola (as can be seen in the schematic representation of FIG. 2).

Preferably, the three-dimensional shape of the working surface 2 corresponds to the envelope, around the central axis, of all the points belonging to all the inclined needle seats.

Figure 5:
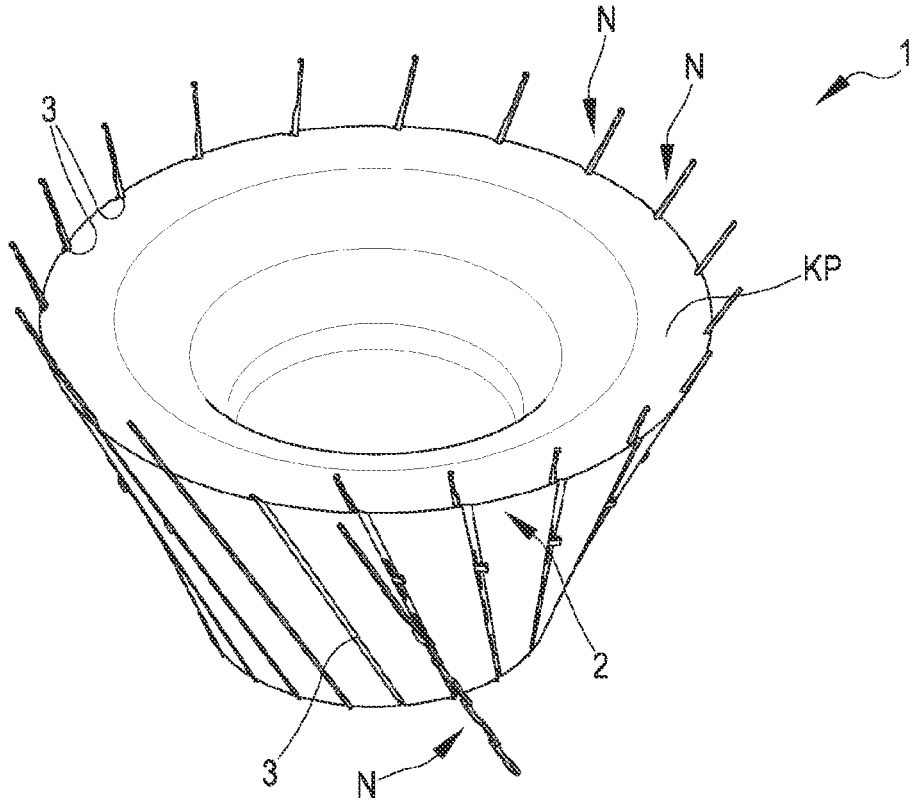
FIG. 5 is a schematic perspective view of a needle-holding unit according to a possible embodiment of the present invention (corresponding to the upper element in FIGS. 1 and 3), provided with a plurality of adjacent inclined needle seats, with a needle in exploded view.
Figure 6:
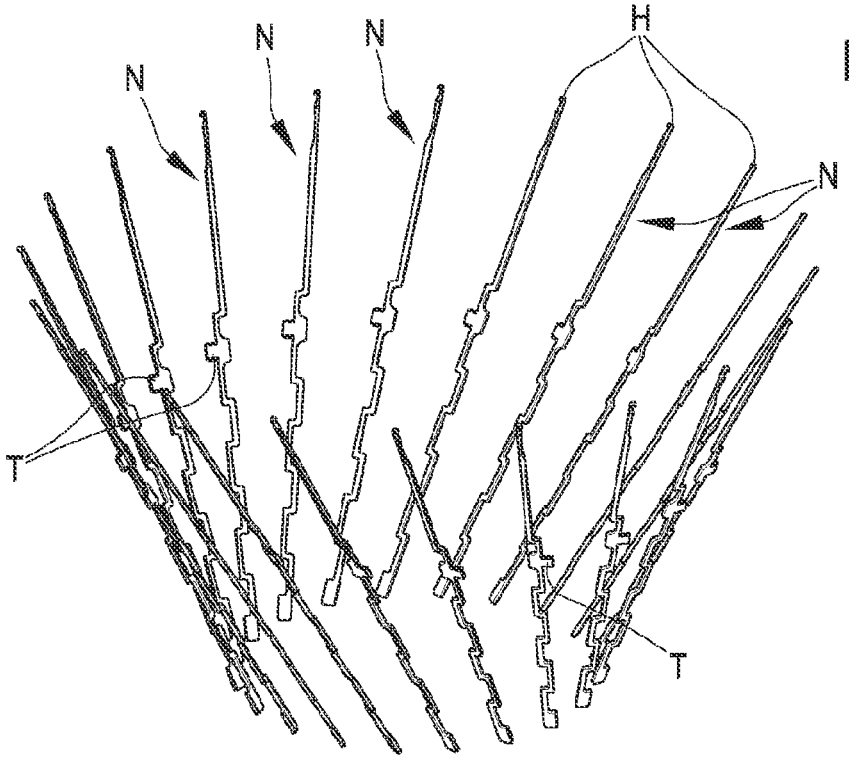
FIG. 6 shows only the needles of the embodiment of FIG. 5, in the position in which they are housed in the respective needle seats.
Figure 8:
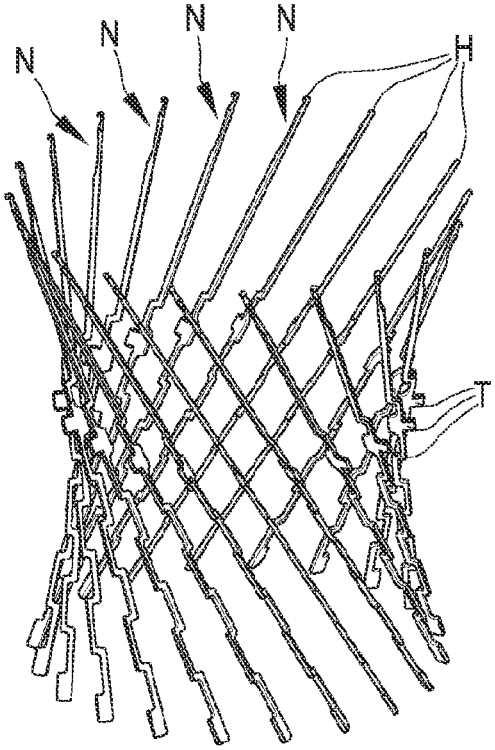
FIG. 8 shows only the needles of the embodiment of FIG. 7, in the position in which they are housed in the respective needle seats.
Figure 9:
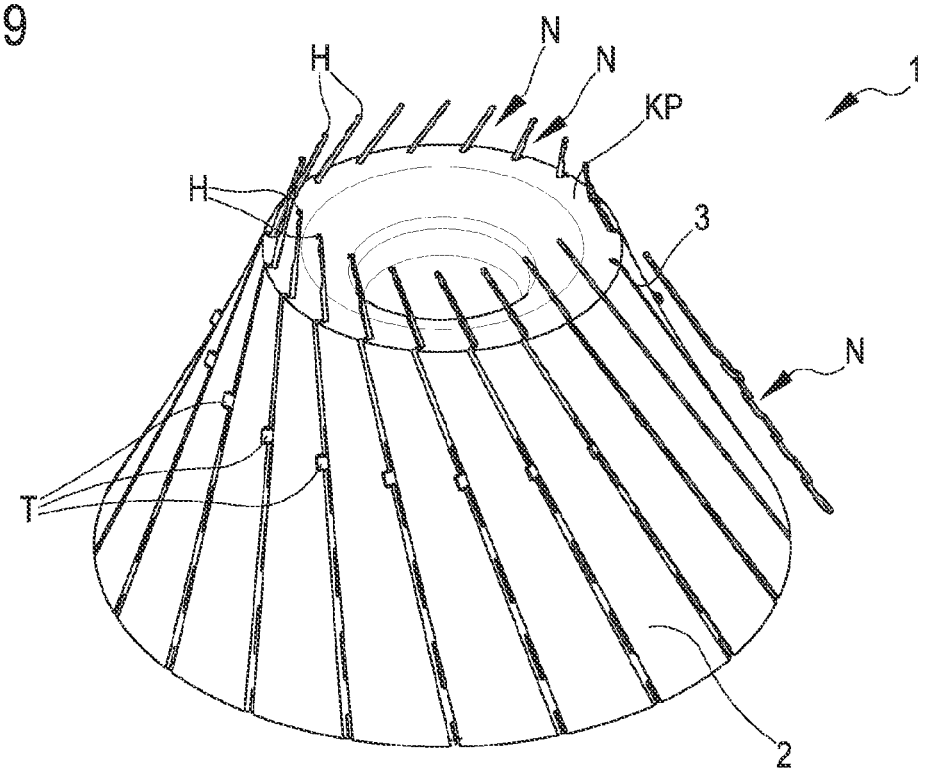
FIG. 9 is a schematic perspective view of a needle-holding unit according to a further possible embodiment of the present invention (corresponding to the lower element in FIGS. 1 and 3), provided with a plurality of adjacent inclined needle seats, with a needle in exploded view.
Figure 10:
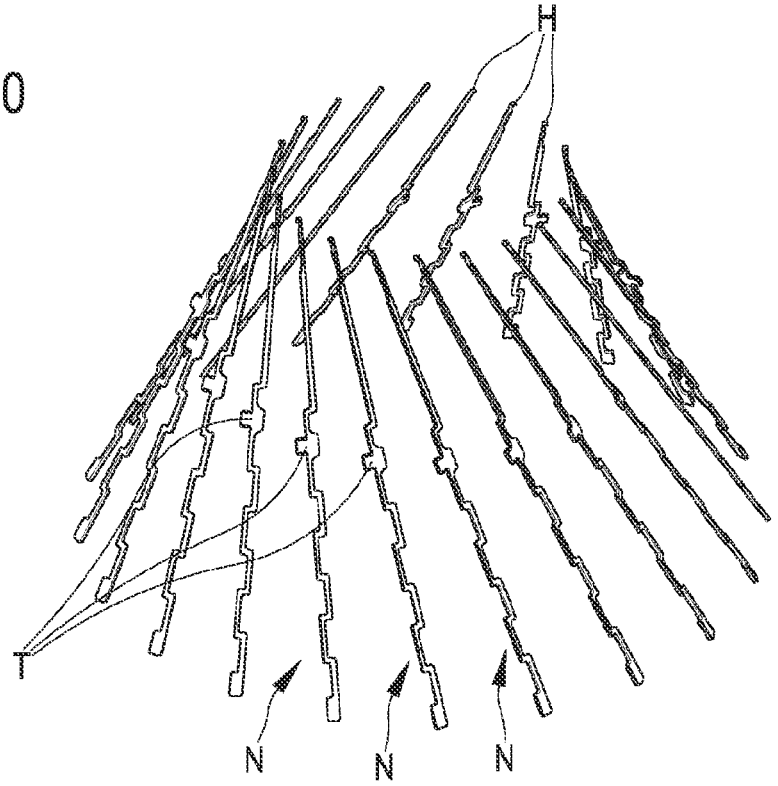
FIG. 10 shows only the needles of the embodiment of FIG. 9, in the position in which they are housed in the respective needle seats.

The envelope of the needle seats, corresponding to the working surface, can be observed in each of the embodiments shown in the figures, and in particular in FIGS. 5-10. FIGS. 6, 8 and 10 show the position taken in space by the needle N only, in needle-holding units according to the present invention.

As schematically shown in FIGS. 11-22, preferably the needle-holding unit 1 comprises control devices 10 associated thereto, arranged outside around the needle-holding unit preferably, during use, in a stationary manner.

The control devices 10 are configured for interacting with the needles N supported by the needle-holding unit 1, as a result of the relative rotation between the needle-holding unit 1, rotating around the central axis Z, and the stationary control devices, so as to transmit a controlled movement to each needle N within the respective needle seat 3, and to cause a movement of the heads of the needles according to a law of motion.

This law of motion describes the position of the heads H of the needles N as a function of the angle of rotation of the needle-holding unit with respect to the central axis Z.

Preferably, the position of the heads H determined by said law of motion follows, during the rotation of the needle-holding unit 1 around the central axis Z, a non-cylindrical, three-dimensional path, whose coordinates may vary both in height, along a direction parallel to the central axis Z, and horizontally, with respect to the knitting plane KP, getting away from or towards the central axis Z during the rotation of the needle-holding unit.

This technical feature can be seen in the figures, in particular in FIGS. 11-22, wherein it can be observed that the needle heads, based on their angular position around the central axis, rise and sink and at the same time get near and away from the central axis Z, following complex three-dimensional trajectories that are not enclosed in cylindrical or conical surfaces.

Preferably, at each moment, or in each position of rotation of the needle-holding unit 1, the position of the head H of the needle N determined by the aforesaid law of motion comprises both a height coordinate, parallel to the central axis Z, and coordinates in a horizontal plane (therefore with respect to axes X and Y), which is parallel to the knitting plane KP and traversing the height coordinate.

Conversely, in traditional needle-holding cylinders, at each moment, or in each position of rotation of the needle-holding unit, the position of the needle head is determined by its vertical height along the needle seat only, i.e. parallel to the central axis, with respect to the knitting plane.

Preferably, the horizontal position of the heads H involves a larger distance from the central axis Z the higher their vertical position (calculated as an absolute value of the distance from the point of minimum distance P), and conversely, the horizontal position of the heads H involves a smaller distance from the central axis Z the lower their vertical position (calculated as an absolute value of the distance from the point of minimum distance P).

Preferably, the height (vertical position) reached by the head H also depends on its radial component, which varies as a function of height but, since the needles always move on the plane of the bottom (tangent to the base cylinder and parallel to the central axis), the radial component (i.e. on the horizontal plane) of the trajectory of the heads is related to height and to parameters characterizing the geometry of the needle-holding unit (in particular the angle of inclination a of the inclined needle seat).

The needles N are inclined with respect to the central axis Z of rotation of the needle-holding unit (of said angle $\alpha$ differing from zero), therefore the needle heads H seen from above on the horizontal plane (see FIGS. 11, 15, 19) does not follow a precise circular motion but, depending on their height, get away from or near the axis of rotation (central axis Z). In particular, the heads get away from the central axis of a farther distance the higher their vertical position (or height).

If we consider the travel of the needle bottom at the level of the knitting plane KP, i.e. the envelope of the open upper ends of the needle seats 3, this corresponds to a circumference whose radius is the same as the radius of the knitting plane rKP. When the heads H of the needles N are in a non-operating position, they move on the knitting plane KP and therefore follow this circumference. Conversely, when the needles are in the operating position (i.e. they get into the needle seats), the heads move on radius that are greater than rKP for positive height values and on radius that are smaller than rKP for negative height values.

Figure 26:
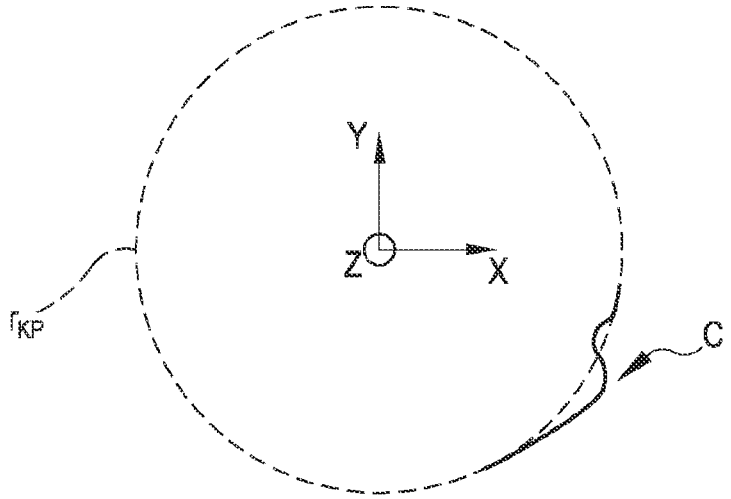
FIG. 26 is a schematic representation of an exemplary trajectory of the needle heads for a needle-holding unit according to the present invention.

Let us consider now the representation of FIG. 26: the circumference in hatches lines represents the path of the heads H of the needles in the non-operating position (i.e. for zero height with respect to the knitting plane KP). The complex curve referred to with C, conversely, represents the projection of the actual path of the heads H on the knitting plane KP when the needle is the operating position and follows the trajectory agreed upon.

The height of the head H with respect to the knitting plane KP being the same, with the increase of the angle of inclination a of the needle seat 3 the heads make circumferences that are larger and larger.

It should be pointed out that in traditional systems (needle-holding cylinders with seats that are not inclined with respect to the central axis) the needles can slide vertically only and there are no other three-dimensional variations of the trajectories. As a matter of fact, between two moments, if the needle-holding unit has made a given angle, also the needle head will have made the same angle and therefore there is no contribution given by the inclination of the needle seat.

Preferably, each needle N of said plurality of needles comprises at least one respective butt T configured for engaging the control devices 10.

Preferably, the control devices 10 comprise a plurality of cams 10 configured for interacting, by means of a respect cam profile or path 11, with the butts T of the needles N, so as to control the ascending and descending motion of each needle inside the respective needle seat 3, according to the aforesaid law of motion.

Preferably, the cam profile or path 11 of each cam 10 develops on a non-cylindrical, non-conical three-dimensional cam surface.

Preferably, the three-dimensional shape of the working surface 2 of the needle-holding unit 1 cooperates with the cam profiles or paths 11 of said plurality of cams 10 in defining said law of motion.

Moreover, the law of motion defined by the working surface 2 and by the cam paths 11 involves, with a constant speed of rotation of the needle-holding unit 1 around the central axis Z, a variable (non-constant) angular speed of the needles Z. As a matter of fact, the angular speed of the needles is a combination of the speed of rotation of the needle-holding unit 1, which is typically constant, with the contribution given by the cam paths 11, which however is variable depending on the profile of this path, and can also be negative with respect to the needle (i.e. pushing it "backwards" in a direction opposed to the rotation of the needle-holding unit).

This means that at a given moment, i.e. considering locally a needle in a given angular position of rotation the needle-holding unit, it can appear "still", i.e. the contribution of constant rotation of the needle-holding unit can be the same as and opposed to the contribution of rotation (in an opposed direction) given by the cam path (depending on its profile), with a resulting instant speed of zero. In general, the combination of three-dimensional shape of the working surface and cam paths allows to select and program the law of motion for the needles.

Preferably, the angle of inclination a of the needle seat 3 with respect to the central axis Z being the same, the three-dimensional shape, as a hyperbolic hyperboloid, of the working surface 2 varies as varies the height of the point of minimum distance P, calculated with respect to the horizontal plane and along a direction parallel to the central axis Z.

Preferably, as the height, as a module or absolute value, of the point of minimum distance P decreases, i.e. as the vertical distance between the knitting plane KP and the point of minimum distance P decreases, the distance from the central axis Z of the points belonging to the upper end 5 of the working surface 2 decreases and the distance from the central axis Z of the point belonging to the lower end 6 of the working surface 2 increases.

Preferably, as the height, as a model or absolute value, of the point of minimum distance P increases, i.e. as the vertical distance between the knitting plane KP and the point of minimum distance P increases, the distance from the central axis Z of the points belonging to the upper end 5 of the working surface 2 increases and the distance from the central axis Z of the points belonging to the lower end 6 of the working surface 2 decreases.

Basically, the point of minimum distance P can be located at different heights thus affecting the profile of the needle-holding unit (in particular of the working surface shaped as a hyperbolic hyperboloid), which may have different protrusions (i.e. radius) in the upper and lower ends.

Once the position of the point of minimum distance P is set and the three-dimensional surface is generated (thanks to the rotation of the needle seat), a given axial "portion" of this surface can be selected, which becomes the working surface 2 of the needle-holding unit.

It should be pointed out that the point of minimum distance P can be enclosed or not in the working surface 2 depending on the axial "sector" of the hyperbolic hyperboloid that was selected to carry out the needle-holding unit.

For instance, the working surface 2 of the embodiment in the middle of FIG. 1 (corresponding to the needle-holding unit of FIG. 7), or of the embodiment of the global embodiment of FIG. 3, have a minimum circumference M enclosing the point of minimum distance P.

The respective working surfaces 2 of the embodiments above and below in FIG. 1, corresponding to the needle-holding units of FIGS. 5 and 9, respectively, however do not enclose the point of minimum distance P, since they correspond to sectors of the hyperbolic hyperboloid that are above and below the point of minimum distance P.

Anyway, the working surfaces of all these embodiments shown by way of example exhibit needle seats that are inclined with the same angle of inclination a, and correspond to portions of the same three-dimensional surface of rotation, which is defined from a geometrical point of view by the same inclined needle seat. In each embodiment, the inclined needle seat is a longitudinal portion (i.e. a segment) of the basic needle seat shown in FIG. 4.

As shown in the figures, the technical solutions according to the present invention allows the needles of the needle seat to exit with said angle of inclination a.

Preferably, the angle of inclination is between 0° and 90°.

Preferably, the needle seat 3 has a rectilinear shape corresponding to its longitudinal development.

Preferably, the needle seat 3 is inclined with respect to the central axis Z in such a direction as to lie at the back along a direction of rotation, during use, of the needle-holding unit.

Preferably, the plurality of needle seats comprises needle seats 3 that are identical to one another and all have the same angle of inclination a.

Preferably, the needle seat 3 is rectilinear and develops in a respective unitary direction of development, which is transversal with respect to the central axis Z and lies on the respective bottom plane.

Below is described a circular knitting machine according to the present invention, which uses a needle-holding unit as described above.

The knitting machine comprises:

- a supporting structure;
- at least one needle-holding unit 1 turnably mounted in the supporting structure so as to rotate around the central axis Z;
- a plurality of needles N movably introduced into the needle seats 3 and moving so as to produce a knitted fabric.

Preferably, each needle 3 houses at least one respective needle N, and each needle N comprises at least one respective butt T and one respective head H.

The knitting machine preferably comprises a plurality of needle control devices 10, or "stitch cams" 10, configured for interacting with the needles N, in particular with the butts T of the needles N, so as to transmit to the needles a given movement inside the respective needle seat during the rotation of the needle-holding unit.

Preferably, each needle N, in particular the respective stem, extends between an upper portion, on which the needle head H is defined, configured for interacting with the yarns so as to produce a knitted fabric, and a lower portion, on which the needle butt T is defined, configured for interacting with the control devices 10.

Each needle is made as one piece, wherein the head H and the butt T are connected to each other in a continuous manner and move integrally inside the respective needle seat 3. Each needle N is configured for moving slidably with an alternate motion inside the respective needle seat 3, following the main longitudinal development of the seat.

Each needle control device 10, or "stitch cam" 10, comprises a respective cam path 11 configured for blocking the butts T of the needles in rotation with the needle-holding unit 1, so that the needle butts enter the cam path 11 and are guided according to a given law of motion so as to make a given sliding movement inside the respective needle seat 3.

Preferably, each needle control device 10 interacts in sequence with the needles N in rotation with the needle-holding unit, so as to impart in sequence the same movement to all the needles in the respective needle seat, wherein each needle makes the movement with a given delay or offset.

Preferably, the cam path 11 of each needle control device 10 extends over its length from an inlet section on which the needles in rotation enter the cam path 11, to an outlet section on which the needles in rotation get out of the cam path 11.

Figure 23:
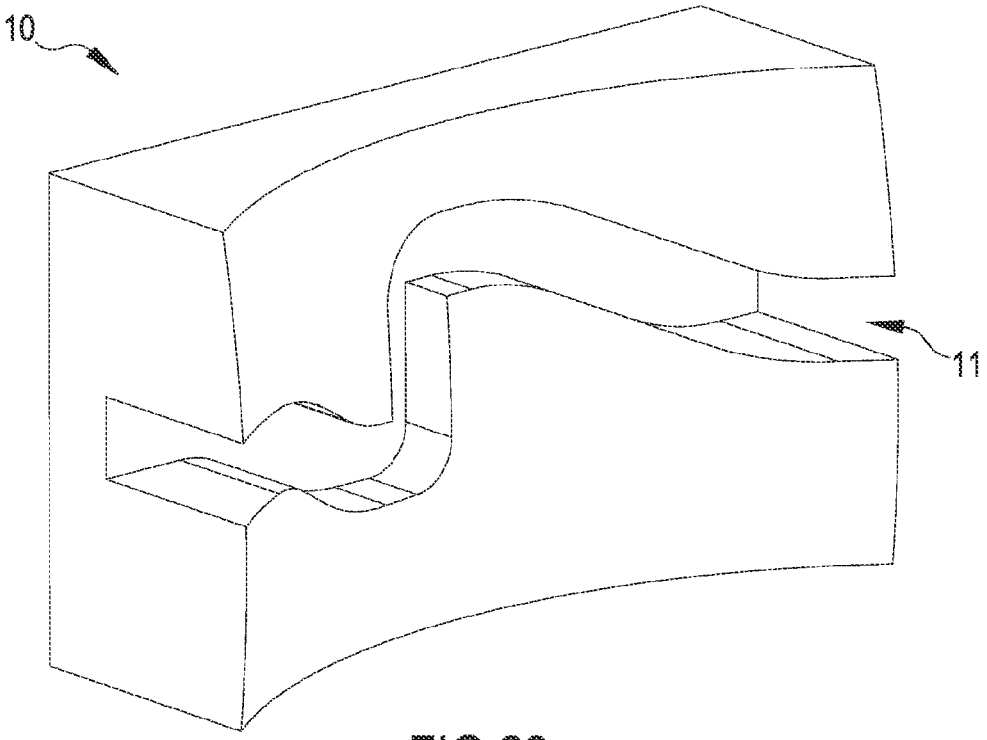
FIG. 23 is a perspective view of a needle control device, alone, belonging to the embodiment of the needle-holding unit of FIG. 20.
Figure 24:
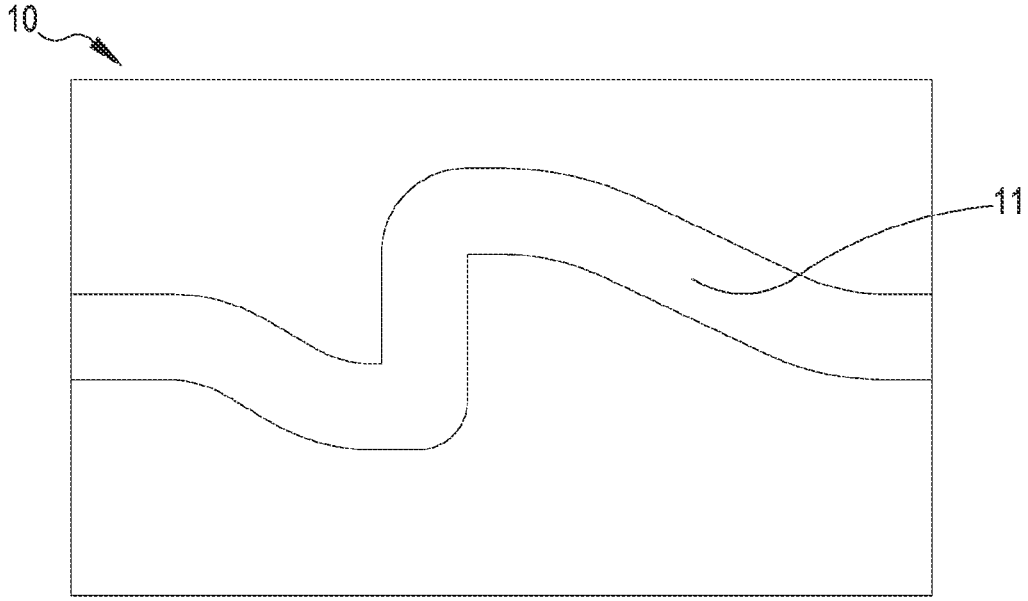
FIG. 24 is a front view of the needle control device of FIG. 23, from the side facing the working surface of the needle-holding unit.

Let us observe in particular FIGS. 23 and 24. Preferably, the cam path 11 of the needle control device 10 has a non-cylindrical, three-dimensional or globoidal shape, such as to be basically matching and facing the working surface 2 of the needle-holding unit 1, in order to interact with the butts T of the needles N during the rotation of the needle-holding unit.

Preferably, for each point of its angular extension around the needle-holding unit, the cam path 11 exhibits:

- a height corresponding to the height of the path point, calculated in a direction parallel to the central axis Z;
- a radial coordinate corresponding to the distance of the point from the central axis.

According to the present invention, the law of motion of the heads H of the needles N is advantageously determined by a combination of the geometrical features of the working surface 2 of the needle-holding unit 1 and of the geometrical features of the cam surfaces on which the cam paths 11 of the plurality of needle control devices 10 develop.

The invention thus conceived can be subjected to various changes and variants, all of which fall within the scope of the inventive idea, and the components mentioned here can be replaced by other technically equivalent element.

The present invention can be used both on new and on existing machines, in the latter case replacing traditional needle-holding units. The invention achieves important advantages. First of all, the invention allows to overcome at least some of the drawbacks of known technique.

In particular, the special shape of the needle-holding unit according to the present invention allows to define advanced laws of motion for the needles, without the limits that are typical of prior art solutions. This can be seen in the possibility of controlling as desired the movement transferred to the needles. The present invention even allows to define the "three-dimensional" law of motion for the needles, i.e. to manage, the position of the needle heads, during the rotation of the needle-holding unit around the central axis, by letting them follow a non-cylindrical, three-dimensional path, whose coordinates may vary both in height, along a direction parallel to the central axis, and horizontally, with respect to the knitting plane, getting away from or towards the central axis as a function of the rotation of the needle-holding unit. This enables to obtain alternative, innovative textile designs and effects with respect to the prior art, thus opening the way to new fields of design.

It should be pointed out that, from a cinematic point of view, in the solution of the present invention both the needle-holding unit (with its inclined needle seats and the three-dimensional working surface) and the stitch cams cooperate together to define the three-dimensional law of motion of the needles, enabling to transmit to the needle heads specific spatial paths; this is a huge step forward with respect to traditional solutions, in which only stitch cams (with their limitations from the point of view of design) are involved in defining the law of motion.

It should further be pointed out that in prior-art technique the angle of pressure of stitch cams is basically related to the slope of the cam profile only, whereas in the solution of the present invention it is related both to the slope and to the inclination of the seat and to the three-dimensional shape of the needle-holding unit and of the cam.

Thus, by selecting a specific three-dimensional shape of the needle-holding cylinder and of its needle seats, the cam path can be shaped or formed with higher slopes.

The higher slope that can be obtained for the cam path in the sinking length enables to reduce the needles simultaneously below the holding-down plane, and thus to limit the tension on the yarns without causing the butts to break. It should be reminded that the reduction of tension thanks to the smaller number of needles below the holding-down plane is due to the fact that there is a smaller number of needles simultaneously blocking and braking the yarn.

It is therefore advantageously possible to increase the fineness of the knitting machine, i.e. the number of needle per inch, since the tensions on the yarns are reduced with respect to known technique. Thanks to the solution of the present invention it is therefore possible to increase the speed of rotation of the needle-holding unit.

Ultimately, the solution of the present invention enables to reduce the actual angle of pressure on the butts so as to obtain a steeper sinking of the heads. The fast sinking enables to improve knitting performance since it causes a fast stitch loading.

Moreover, the present invention enables to increase the performance of a knitting machine, and in particular to increase the fineness of the knitting machine (e.g. up to values of 60, 90 or above). In addition, the present invention enables to reduce or eliminate the breaking of the butts of the needles cooperating with the stitch cams. Moreover, the present invention enables to reduce or eliminate the breaking of the yarns, in particular with high finenesses.

Furthermore, the present invention enables to reduce failures or malfunctions of a circular knitting machines and/or ensures a higher efficiency in time. Moreover, the needle-holding unit of the present invention is characterized by a competitive cost and by a simple and rational structure.

The invention claimed is:

1. A needle-holding unit (1) for circular knitting machines, configured to be turnably mounted to a supporting structure of a circular knitting machine, the needle-holding unit (1) having a structure shaped as a hollow solid of rotation developing around a central axis (Z), the needle-holding unit being configured for turning around said central axis and for supporting a plurality of needles (N) moving so as to produce a knitted fabric;

- the needle-holding unit (1) having on an outer side thereof at least one working surface (2), wherein a plurality of needle seats (3) placed one beside the other and arranged around said central axis (Z) is defined on the working surface (2);
- each one of said needle seats (3) being configured for movably housing at least one portion of at least a respective needle (N) to be actuated with an alternate motion along the respective needle seat (3) with a motion of extraction, by which the needle (N) is taken out with its head (H) and with a portion of its stem above of the needle-holding unit through an upper end of the respective needle seat (3) so as to discharge on its stem the knitted loop previously formed and/or for taking the yarn or yarns supplied on a machine feed, and with a motion of return, so as to form a new knitted loop by holding down the knitted loop previously formed; and wherein each needle seat (3) of said plurality of needle seats has a longitudinal development inclined with respect to the central axis (Z), wherein the working surface (2) has a shape as a surface of rotation obtained through the rotation of said needle seat (3) around the central axis (Z), and wherein the working surface (2) is a non-cylindrical, non-conical three-dimensional surface.

2. The needle-holding unit (1) according to claim 1, wherein said working surface (2) is a one-sheeted hyperboloid or hyperbolic hyperboloid.

3. The needle-holding unit (1) according to claim 1, wherein said working surface (2) is a doubly ruled surface.

4. The needle-holding unit (1) according to claim 1, wherein the needle-holding unit (1) is equipped above with a knitting plane (KP) which the upper ends of the needle seats (3) point towards, destined to receive resting thereon the knitted portions between two adjacent needles (N) while these, after taking the yarn from a machine feed, get back into the respective needle seats (3), and wherein the needle-holding unit is equipped with a Cartesian reference system defined by three mutually orthogonal axes, wherein:

a first vertical axis (Z) coincides with said central axis (Z); and a second horizontal axis (X) and a third horizontal axis (Y) define a horizontal plane, orthogonal to said first axis (Z), traversing the knitting plane (KP), and wherein the needle-holding unit is equipped with a cylindrical reference system, wherein each point of the working surface may be defined by three coordinates:

a radial coordinate corresponding to the distance of the point from the central axis (Z);

an angular coordinate corresponding to the angular distance with respect to the origin on the horizontal plane; and an axial coordinate corresponding to the height of the point, calculated in a direction parallel to the central axis (Z), with respect to the horizontal plane.

5. The needle-holding unit (1) according to claim 1, wherein the distance from the central axis (Z), calculated on planes parallel to the horizontal plane, of each point of the working surface (2) varies for each vertical height, along a direction parallel to the central axis, in a non-linear manner.

6. The needle-holding unit (1) according to claim 1, wherein:

the working surface (2) has an upper end (5) and a lower end (6), between which a central section is placed, and the distance from the central axis (Z), calculated on planes parallel to the horizontal plane, of the points belonging to the upper end (5) and to the lower end (6) is larger than the distance of the points belonging to the central section; or wherein the working surface (2) has an upper end (5) and a lower end (6), and the distance from the central axis (Z), calculated on planes parallel to the horizontal plane, of the points belonging to the upper end (5) is larger than the distance of the points belonging to the lower end (6), or wherein the working surface (2) has an upper end (5) and a lower end (6), and the distance from the central axis (Z), calculated on planes parallel to the horizontal plane, of the points belonging to the lower end (5) is larger than the distance of the points belonging to the upper end (6).

7. The needle-holding unit (1) according to claim 1, wherein said working surface (2) defines a minimum circumference (M) lying on a plane parallel to said horizontal plane and comprising all of its points having a minimum radial distance (rTAN) from the central axis (Z), and wherein the intersection between a plurality of planes parallel to the horizontal plane, each at a different vertical height along the vertical axis (Z), and the working surface (2) identifies a plurality of horizontal surfaces, each circumference being defined by all of the points of the working surface (2) placed at the respective height of the circumference itself and at a distance from the central axis (Z) corresponding to the radius of the circumference itself.

8. The needle-holding unit (1) according to claim 7, wherein each needle seat (3) is configured for housing at least one respective needle (N) having a rectilinear shape, and has a bottom surface of the seat, or bottom, on which said at least one respective needle (N) slides, and/or wherein, said needle seat (3) being inclined with respect to the central axis (Z), the bottom surface of the seat has a point of minimum distance (P) from the central axis (Z) and lies on a bottom plane, said bottom plane being parallel to the central axis (Z) and tangent to a base cylinder of the needle-holding unit, said base cylinder having a radius corresponding to said minimum radial distance (rTAN), and wherein the needle seat (3) is configured for determining and guiding the sliding of the needle (N) housed by it on the bottom surface on said bottom plane.

9. The needle-holding unit (1) according to claim 8, wherein the combination of the inclination of said needle seat (3) with the three-dimensional shape of said working surface (2) is such as to defined a linear bottom, lying on the respective bottom plane, tangent to the base cylinder.

10. The needle-holding unit (1) according to claim 8, wherein the bottom plane is tangent to the base cylinder in a segment of contact, which is vertical and parallel to the central axis (Z), said segment of contact comprising, i.e. traversing, said point of minimum distance (P), and/or wherein all the needle seats (3) of said plurality of needle seats have an inclination with respect to the central axis (Z) corresponding to an angle of inclination ($\alpha$) different from zero, said angle of inclination being the smallest angle formed by each needle seat (3), on its bottom plane, with the respective segment of contact.

11. The needle-holding unit (1) according to claim 1, comprising control devices (10) associated thereto, arranged outside around the needle-holding unit in a stationary manner and configured for interacting with the needles (N) supported by the needle-holding unit, as a result of the relative rotation between the needle-holding unit (1), rotating around the central axis (Z), and the control devices, so as to transmit a controlled movement to each needle (N) within the respective needle seat (3), and to cause a movement of the heads (H) of the needles according to a law of motion;

wherein said law of motion describes the position of the heads (H) as a function of the angle of rotation of the needle-holding unit with respect to the central axis (Z), and wherein the position of the heads (H) of the needles (N) determined by said law of motion follows, during the rotation of the needle-holding unit around the central axis (Z), a non-cylindrical, non-conical three-dimensional path, whose coordinates may vary both in height, along a direction parallel to the central axis (Z), and horizontally, with respect to the knitting plane (KP), getting away from or towards the central axis (Z) during the rotation of the needle-holding unit.

12. The needle-holding unit (1) according to claim 11, wherein at each moment, or in each position of rotation of the needle-holding unit, the position of the head (H) of the needle (N) determined by said law of motion comprises both a height coordinate, parallel to the central axis (Z), and coordinated in a horizontal plane, which parallel to the knitting plane (KP) and traversing the height coordinate.

13. The needle-holding unit (1) according to claim 1, wherein, said angle of inclination ($\alpha$) of the needle seat (3) with respect the central axis (Z) being the same, the three-dimensional shape of the working surface (2) varies as varies the height of said point of minimum distance (P), calculated with respect to the horizontal plane and along a direction parallel to the central axis (Z), or wherein, as the height, as a module or absolute value, of the point of minimum distance (P) decreases, i.e. as the vertical distance between the knitting plane (KP) and the point of minimum distance (P) decreases, the distance from the central axis (Z) of the points belonging to the upper end (5) of the working surface (2) decreases and the distance from the central axis (Z) of the point belonging to the lower end (6) of the working surface (2) increases, or wherein, as the height, as a model or absolute value, of the point of minimum distance (P) increases, i.e. as the vertical distance between the knitting plane (KP) and the point of minimum distance (P) increases, the distance from the central axis (Z) of the points belonging to the upper end (5) of the working surface (2) increases and the distance from the central axis (Z) of the point belonging to the lower end (6) of the working surface (2) decreases.

14. A circular knitting machine for knitted or hosiery items, comprising:

a supporting structure;

at least one needle-holding unit (1) according to claim 1;

a plurality of needles (N) movably introduced into the needle seats (3) of the needle-holding unit (1) and moving so as to produce a knitted fabric, wherein each needle seat (3) houses at least one respective needle (N), each needle comprising at least one respective butt (T) and one respective head (H); and a plurality of needle control devices (10) or "stitch cams" (10), configured for interacting with the needles (N) so as to transmit to the needles a given movement inside the respective needle seat (3) during the rotation of the needle-holding element, wherein each needle (N) extends between an upper portion, on which the needle head (H) is defined, configured for interacting with the yarns so as to produce a knitted fabric, and a lower portion, on which the needle butt (T) is defined, configured for interacting with said control devices (10), each needle (N) having a unitary shape in which head and butt are connected continuously and move integrally inside the respective needle seat (3), and wherein each needle is configured for moving slidably with an alternate motion inside the respective needle seat, following the main longitudinal development of the seat.

15. The circular knitting machine according to claim 14, wherein each needle control device (10) comprises a respective cam path (11) configured for catching the butts (T) of the needles (N) rotating with the needle-holding unit (1), so that the needle butts get into said cam path (11) and are guided, according to a given law of motion, so as to make a given sliding movement inside the respective needle seat (3), wherein the cam path (11) of said needle control device (10) has a non-cylindrical, three-dimensional or globoidal shape, such as be matching and facing, at a given distance, said working surface (2) of the needle-holding unit, in order to interact with the butts (T) of the needles (N) during the rotation of the needle-holding unit, and wherein, for each point of its angular extension around the needle-holding unit, said cam path (11) exhibits:

a height corresponding to the height of the path point, calculated in a direction parallel to the central axis (Z); and a radial coordinate corresponding to the distance of the point from the central axis (Z), and/or wherein the law of motion of the heads (H) of the needles (N) is determined by a combination of the geometrical features of the working surface (2) of the needle-holding unit (1) and of the geometrical features of the cam surfaces on which the cam paths (11) of said plurality of needle control devices (10) develop.

16. The needle-holding unit (1) according to claim 1, wherein said working surface (2) is a non-degenerate quadric.

17. The needle-holding unit (1) according to claim 1, wherein said working surface (2) is a concave surface, developing all around the central axis, the concavity pointing outside the needle-holding unit.

18. The needle-holding unit (1) according to claim 4, wherein said knitting plane (KP) of the needle-holding unit lies on said horizontal plane or is coplanar therewith, or wherein the Cartesian reference system and the cylindrical reference system have the same point of origin.

19. The needle-holding unit (1) according to claim 1, wherein the three-dimensional shape of the working surface (2) corresponds to the envelope, around the central axis (Z), of all the points belonging to all the inclined needle seats, or wherein the intersection of each vertical plane traversing the central axis (Z) with the working surface identifies two branches of a hyperbola.

20. The needle-holding unit (1) according to claim 1, wherein said three-dimensional shape of the working surface (2) is as a hyperbolic hyperboloid.

* * * * *